US009910384B2

(12) United States Patent
Sato

(10) Patent No.: US 9,910,384 B2
(45) Date of Patent: Mar. 6, 2018

(54) IMAGE FORMING APPARATUS AND DRUM CARTRIDGE

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/286,851

(22) Filed: Oct. 6, 2016

(65) Prior Publication Data

US 2017/0102641 A1 Apr. 13, 2017

(30) Foreign Application Priority Data

Oct. 7, 2015 (JP) ..... 2015-199114

(51) Int. Cl.
*G03G 15/08* (2006.01)
*G03G 21/18* (2006.01)
*G03G 21/16* (2006.01)

(52) U.S. Cl.
CPC ..... *G03G 15/0886* (2013.01); *G03G 15/0865* (2013.01); *G03G 15/0877* (2013.01); *G03G 21/1676* (2013.01); *G03G 2215/0692* (2013.01)

(58) Field of Classification Search
CPC ..... G03G 15/0886; G03G 15/0865; G03G 15/0877; G03G 15/0832; G03G 15/0896; G03G 21/1676; G03G 2215/066; G03G 2215/0692; G03G 2221/163; G03G 2221/1684; G03G 2221/1853
USPC ..... 399/111, 119, 120, 260, 262
See application file for complete search history.

(56) References Cited

U.S. PATENT DOCUMENTS 5,835,822 A * 11/1998 Nagasaki ..... G03G 15/0865 399/111 X
6,137,972 A * 10/2000 Playfair ..... G03G 15/0886 399/262 X
6,792,230 B2 * 9/2004 Saito ..... G03G 21/1821 399/111
7,412,189 B2 * 8/2008 Jeong ..... G03G 15/104 399/120 X
8,073,357 B2 12/2011 Sakuma
(Continued)

FOREIGN PATENT DOCUMENTS

JP 2009-151280 A 7/2009
JP 2009-193007 A 8/2009
JP 2009-237252 A 10/2009

*Primary Examiner* — Sophia S Chen
(74) *Attorney, Agent, or Firm* — Banner & Witcoff, Ltd.

(57) ABSTRACT

An image forming apparatus includes: a photosensitive drum; a toner cartridge having a toner supply port; and a developing unit including: a developing roller; a developing frame; and a conveyance portion capable of conveying toner contained in the toner cartridge to the developing frame. The conveyance portion including: a coupling tube capable of being coupled to the toner cartridge and having a toner receiving port that faces the toner supply port in a state where the coupling tube is coupled to the toner cartridge; a conveyance tube fixed to the developing frame, the conveyance tube being movable with respect to the coupling tube, in a state where the coupling tube is coupled to the toner cartridge and the toner receiving port faces the toner supply port; and a shutter movable between an open position and a closed position.

18 Claims, 11 Drawing Sheets

(56) References Cited

U.S. PATENT DOCUMENTS

| | | | | |
|---|---|---|---|---|
| 8,180,260 | B2 | 5/2012 | Yanagi | |
| 8,185,022 | B2 | 5/2012 | Sato | |
| 8,565,650 | B2 | 10/2013 | Sato | |
| 8,897,679 | B2 * | 11/2014 | Kawashima | G03G 21/1676 399/111 |
| 2009/0052940 | A1 * | 2/2009 | Mizuno | G03G 21/12 399/120 |
| 2009/0142105 | A1 | 6/2009 | Yanagi | |
| 2009/0208245 | A1 | 8/2009 | Sato | |
| 2009/0214257 | A1 * | 8/2009 | Kweon | G03G 15/0898 399/120 |
| 2009/0245854 | A1 | 10/2009 | Sakuma | |
| 2012/0009514 | A1 * | 1/2012 | Nagayama | G03G 9/0821 399/111 X |
| 2012/0213556 | A1 | 8/2012 | Sato | |
| 2015/0261173 | A1 * | 9/2015 | Sato | G03G 21/12 399/113 |

* cited by examiner

IMAGE FORMING APPARATUS AND DRUM CARTRIDGE

CROSS-REFERENCE TO RELATED APPLICATION

This application claims priority from Japanese Patent Application No. 2015-199114 filed on Oct. 7, 2015, the entire subject matter of which is incorporated herein by reference.

BACKGROUND

This disclosure relates to an image forming apparatus that employs an electrophotographic method, and a drum cartridge to be mounted to the image forming apparatus.

There is an image forming apparatus that employs an electrophotographic method and includes a photosensitive drum, a developing unit having a developing roller, and a toner cartridge that accommodates toner.

As an image forming apparatus, there is an image forming apparatus in which a supply port of a toner cartridge and a receiving port of a developing unit face each other to supply toner contained in the toner cartridge is supplied to the developing unit.

In such image forming apparatus, the developing unit is configured to swings with respect to the photosensitive drum.

SUMMARY

The developing unit swings not only with respect to the photosensitive drum but also with respect to the toner cartridge. Therefore, the receiving port of the developing unit may deviate in position from the supply port of the toner cartridge, thereby causing toner leakage.

In order that the supply port of the toner cartridge does not deviate in position from the receiving port of the developing unit, a technique for swinging the toner cartridge together with the developing unit is considered. In this case, however, in a state where the amount of toner contained in the toner cartridge is large, it is difficult to swing the toner cartridge together with the developing unit.

This disclosure provides an image forming apparatus and a drum cartridge that can suppress toner leakage between the toner cartridge and the developing unit even when the toner cartridge and the developing unit move relatively to each other.

An image forming apparatus of this disclosure includes a photosensitive drum; a toner cartridge having a toner supply port; and a developing unit. The developing unit includes a developing roller; a developing frame; and a conveyance portion capable of conveying toner contained in the toner cartridge to the developing frame. The conveyance portion includes: a coupling tube capable of being coupled to the toner cartridge and having a toner receiving port that faces the toner supply port in a state where the coupling tube is coupled to the toner cartridge; a conveyance tube fixed to the developing frame, the conveyance tube being movable with respect to the coupling tube, in a state where the coupling tube is coupled to the toner cartridge and the toner receiving port faces the toner supply port; and a shutter movable between an open position, at which the toner receiving port is opened in a state where the coupling tube is coupled to the toner cartridge, and a closed position, at which the toner receiving port is closed in a state where the coupling tube is uncoupled from the toner cartridge.

A developing unit to which a toner cartridge having a toner supply port is mountable includes, a developing roller; a developing frame; and a conveyance portion configured to convey toner contained in the toner cartridge to the developing frame. The conveyance portion includes a coupling tube capable of being coupled to the toner cartridge, the coupling tube having a toner receiving port that faces the toner supply port when the coupling tube is coupled to the toner cartridge; and a conveyance tube is fixed to the developing frame, the conveyance tube being movable with respect to the coupling tube when the coupling tube is coupled to the toner cartridge and the toner receiving port faces the toner supply port.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Figure 1:
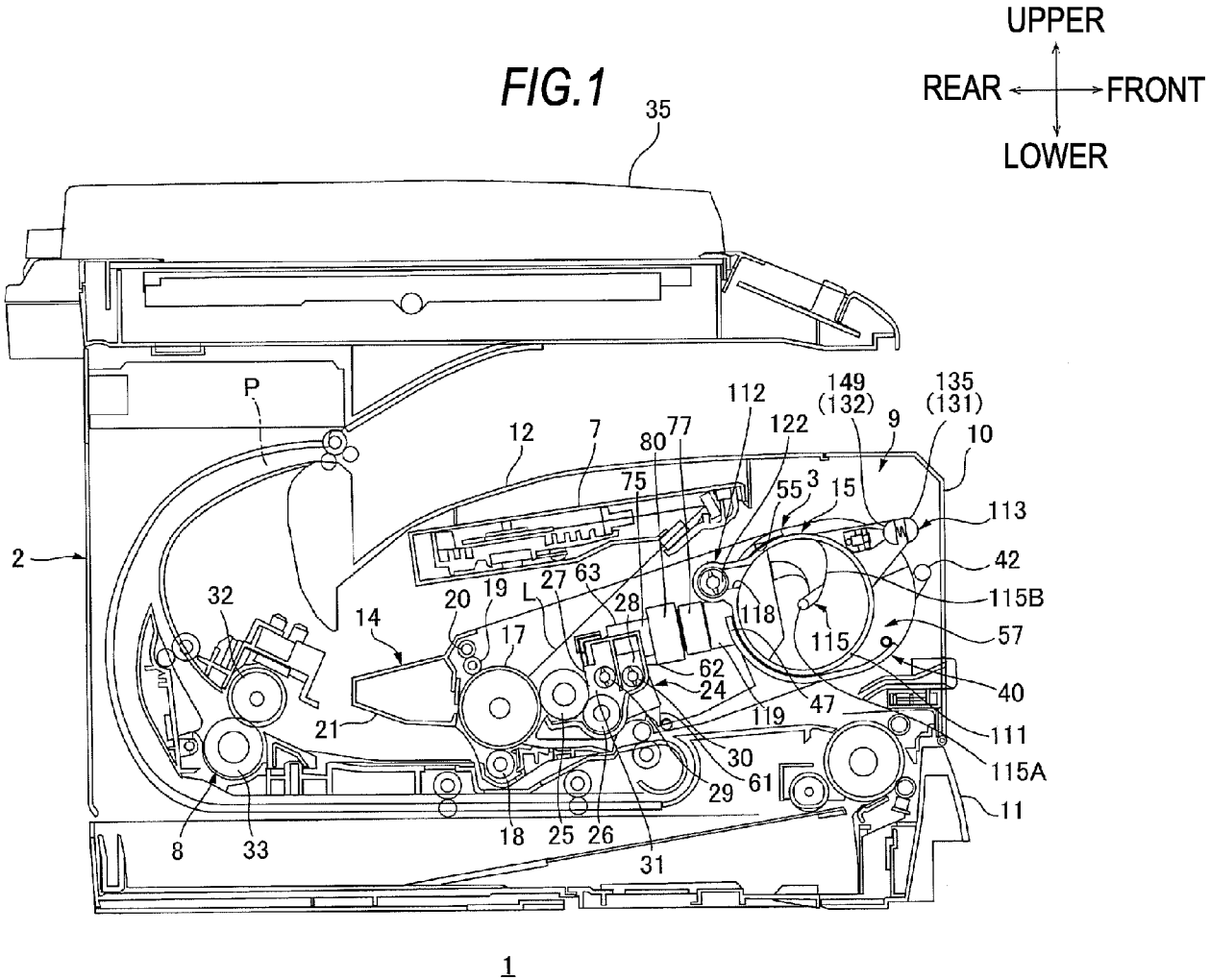
FIG. 1 is a cross-sectional view at a center illustrating an image forming apparatus according to an embodiment of the invention.

An image forming apparatus 1 will be described below. In the following description, directions will be specified based on directions indicated by arrows as illustrated in the drawings.

1. Outline of Printer

As illustrated in FIG. 1, the image forming apparatus 1 is a monochromatic printer employing an electrophotographic method. The image forming apparatus 1 includes a main body 2 having an opening 9, a process cartridge 3, a scanning unit 7, a fixing unit 8, and a reading unit 35.

The main body 2 has an almost box shape. The main body 2 includes a front cover 10, a sheet supply tray 11, and a sheet discharge tray 12.

The opening 9 is positioned at a front end of the main body 2. The opening 9 is formed communicate between the inside and outside of the main body 2. The opening 9 allows the process cartridge 3 to pass therethrough.

The front cover 10 is positioned at the front end of the main body 2. The front cover 10 has an almost plate shape extending in an up-down direction. The front cover 10 is supported by the front end of the main body 2 so as to be pivotally swingable around a lower end of the front cover 10. The front cover 10 is swingable between an open position at which the opening 9 is opened and a closed position at which the opening 9 is closed (see FIGS. 10 and 11).

The sheet supply tray 11 is positioned at a lower end of the main body 2. The sheet supply tray 11 is configured to accommodate sheets P of paper.

The sheet discharge tray 12 is positioned at a substantially center in a front-rear direction of an upper surface of the main body 2. The sheet discharge tray 12 is recessed downward form the upper surface of the main body 2 so that the sheets P are placed thereon.

The process cartridge 3 is mountable to and demountable from the main body 2. The process cartridge 3 is positioned at a substantially vertical center inside the main body 2. The process cartridge 3 is positioned above the sheet supply tray 11 and below of the sheet discharge tray 12. The process cartridge 3 includes a drum unit 14 and a toner cartridge 15.

The drum unit 14 includes a photosensitive drum 17, a transfer roller 18, a charging roller 19, a charging cleaning roller 20 configured to remove extraneous matters such as a residual toner or sheet dust adhered onto a surface of the charging roller 19, a drum cleaning unit 21 configured to collect the extraneous matters adhered to the photosensitive drum 17 and store them, and a developing unit 24.

The photosensitive drum 17 is positioned at a rear end of the drum unit 14. The photosensitive drum 17 has an almost cylindrical shape extending in a right-left direction.

The transfer roller 18 is positioned below the photosensitive drum 17. The transfer roller 18 is in contact with the photosensitive drum 17.

The charging roller 19 is positioned at a rear upper side of the photosensitive drum 17. The charging roller 19 is in contact with the photosensitive drum 17. The charging roller 19 is configured to charge the surface of the photosensitive drum 17.

The developing unit 24 is positioned in front of the photosensitive drum 17. The developing unit 24 includes a developing roller 25, a supply roller 26, and a layer thickness regulation blade 27.

The developing roller 25 is positioned at a rear end of the developing unit 24. The developing roller 25 is in contact with a front side of a front circumferential surface of the photosensitive drum 17. The developing roller 25 is rotatably supported by the developing unit 24. That is, the developing roller 25 and the photosensitive drum 17 are arranged in the front-rear direction.

The supply roller 26 is positioned at a front lower side of the developing roller 25. The supply roller 26 is in contact with a surface at a front lower side of the developing roller 25. The supply roller 26 is rotatably supported by the developing unit 24.

The layer thickness regulation blade 27 is positioned at a front upper side of the developing roller 25. A lower end of the layer thickness regulation blade 27 is in contact with a front surface of the developing roller 25.

The toner cartridge 15 is mountable to and demountable from the drum unit 14. The toner cartridge 15 is positioned in front of the developing unit 24. The toner cartridge 15 can accommodate a toner. Although details will be described below, the toner cartridge 15 can supply the toner accommodated therein to the developing unit 24.

The scanning unit 7 is positioned above the process cartridge 3. The scanning unit 7 can emit a laser beam L based on image data toward the photosensitive drum 17.

The fixing unit 8 is positioned in the rear of the process cartridge 3. The fixing unit 8 includes a heating roller 32 and a pressing roller 33 coming in contact with the heating roller 32.

The reading unit 35 is positioned above the main body 2. The reading unit 35 is positioned above the sheet discharge tray 12 while keeping an interval. The reading unit 35 is a flat bed image scanner. The reading unit 35 is configured to read image information of an original document.

2. Drum Cartridge

Figure 2:
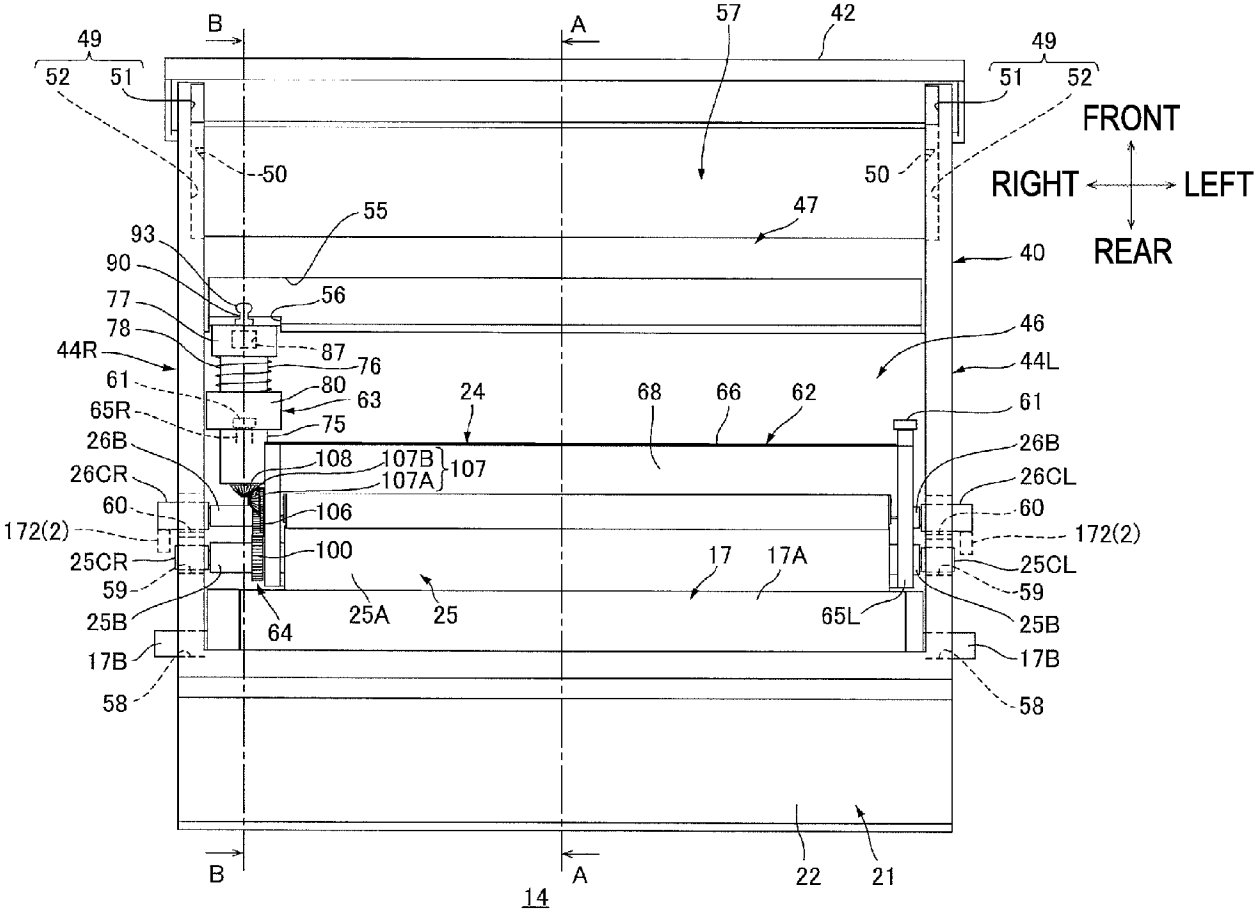
FIG. 2 is a plan view of a drum cartridge illustrated in FIG. 1.
Figure 3A:
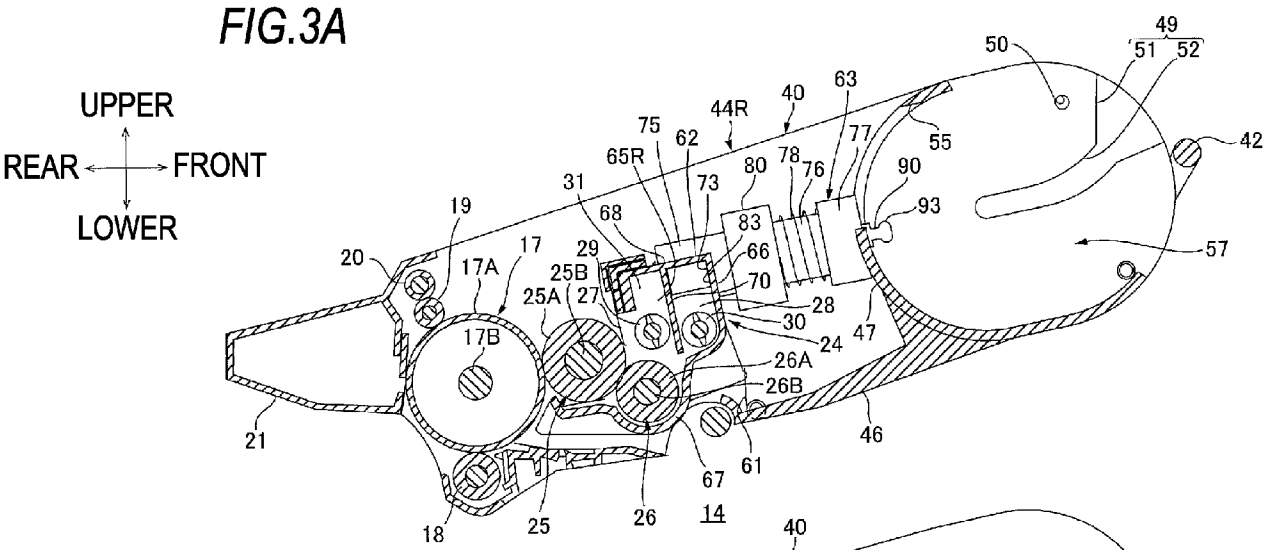
FIG. 3A is a cross-sectional view taken along line A-A of the drum cartridge illustrated in FIG. 2.

The drum unit 14 includes a frame 40 that supports the photosensitive drum 17 and the developing unit 24 as illustrated in FIGS. 2 and 3A.

(1) Frame

The frame 40 includes a right sidewall 44R, a left sidewall 44L, a lower wall 46, a partition wall 47, and a drum handle 42, the partition wall 47 including an insertion hole 55 through which a supply portion 112 (which will be described below) of the toner cartridge 15 is inserted and a notch 56 through which a coupling tube 76 of a conveyance portion 63 (which will be described below) is inserted.

The sidewall 44R includes a guide portion 49, a fixing hole 50 to which a first rod 161 (which will be described below) of the toner cartridge 15 is fitted, a hole 58 into which the photosensitive drum 17 is inserted, a first elongate hole 59 as an example of a first guide into which the developing roller 25 is inserted, and a second elongate hole 60 as an example of a first guide into which the supply roller 26 is inserted.

Similarly to the sidewall 44R, the sidewall 44L includes the guide portion 49, the fixing hole 50, the hole 58, the first elongate hole 59, and the second elongate hole 60.

The guide portion 49 and the fixing hole 50 are intended to be described with respect to the sidewall 44R, and the hole 58, the first elongate hole 59, and the second elongate hole 60 are intended to be described with respect to the sidewall 44L.

The sidewall 44R is positioned at a right end of the frame 40. The sidewall 44R extends in the up-down direction and the front-rear direction. The sidewall 44R has a plate shape.

The guide portion 49 is positioned at a front end of the sidewall 44R. The guide portion 49 is recessed outward in the right-left direction from an inner surface in the right-left direction of the sidewall 44R. The guide portion 49 includes a first groove 51 and a second groove 52 as an example of a second guide.

The first groove 51 extends downward and rearward from a front upper end of the sidewall 44R as illustrated in FIG. 3A. As the first groove 51 extends downward and rearward, the groove becomes smaller in width. The first groove 51 has an almost triangular shape as seen in side view.

The second groove 52 is continuous from a rear lower end of the first groove 51. The second groove 52 extends rearward from the rear lower end of the first groove 51. In detail, the second groove 52 has a curved part that is curved rearward from the rear lower end of the first groove 51 and a straight part that extends rearward from a rear end of the curved part. The straight part of the second groove 52 extends along a moving direction of a conveyance tube 75 which will be described below.

As illustrated in FIGS. 2 and 3A, the fixing hole 50 is positioned in the rear of the first groove 51 and above the front end of the second groove 52. The fixing hole 50 is recessed outward in the right-left direction from the right/left inner surface of the sidewall 44R. The fixing hole 50 has an almost circular shape as seen in side view.

Figure 3B:
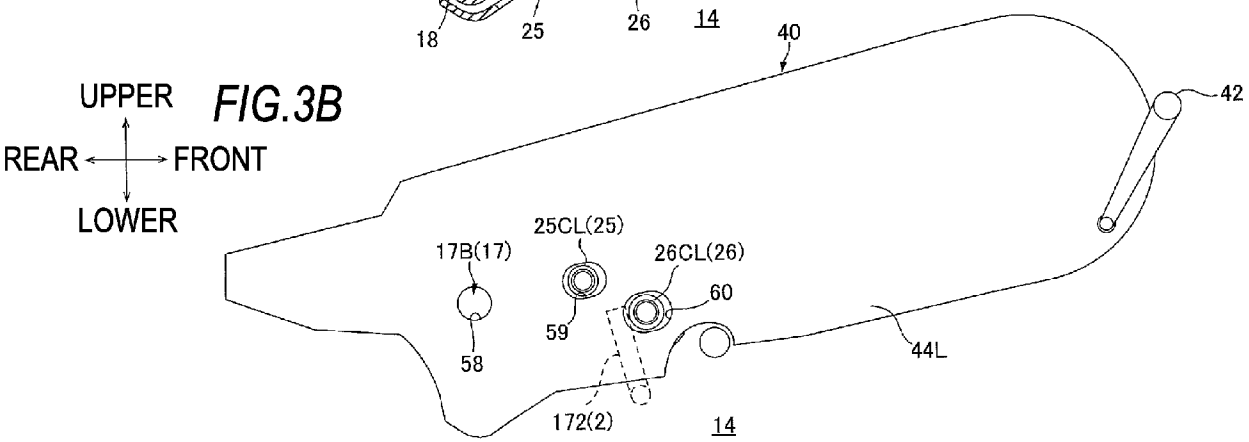
FIG. 3B is a side view of the drum cartridge illustrated in FIG. 2.

The sidewall 44L is positioned at a left end of the frame 40 as illustrated in FIGS. 2 and 3B. The sidewall 44L extends in the up-down direction and the front-rear direction. The sidewall 44L has a plate shape.

The hole 58 is positioned in front of the drum cleaning unit 21 as viewed from the right-left direction. The hole 58 penetrates through the sidewall 44L in the right-left direction. The hole 58 has a circular shape as seen in side view.

The first elongate hole 59 is positioned in front of the hole 58. The first elongate hole 59 penetrates through the sidewall 44L in the right-left direction. The first elongate hole 59 has a long-hole shape extending in the front-rear direction.

The second elongate hole 60 is positioned at a front lower side of the first elongate hole 59. The second elongate hole 60 penetrates through the sidewall 44L in the right-left direction. The second elongate hole 60 has a long-hole shape extending in the front-rear direction.

As illustrated in FIGS. 2 and 3A, the lower wall 46 is positioned at the lower end of the frame 40. The lower wall 46 is positioned between the lower end of the sidewall 44R and the lower end of the sidewall 44L. The lower wall 46 extends in the right-left direction and the front-rear direction. The lower wall 46 has a plate shape. The lower wall 46 is provided with two springs 61.

The two springs 61 are positioned substantially at a center of the lower wall 46 in the front-rear direction. The two springs 61 are positioned in front of the developing unit 24. The two springs 61 are spaced apart from each other with an interval in the right-left direction. Each of the springs 61 is a coil spring. A base end of the spring 61 is fixed to the lower wall 46. A free end of the spring 61 extends upward.

The partition wall 47 is positioned in the rear of the second groove 52 of the sidewall 44R and the sidewall 44L as viewed in the right-left direction. The partition wall 47 is positioned between the developing unit 24 and the second groove 52. The partition wall 47 extends upward from the substantially center of the lower wall 46 in the front-rear direction. The partition wall 47 is positioned between the sidewall 44R and the sidewall 44L. The partition wall 47 is curved frontward as it extends upward. The partition wall 47 has an almost arc shape around the rear end of the second groove 52.

The insertion hole 55 is positioned at a top of the partition wall 47. The insertion hole 55 penetrates through the partition wall 47 in the front-rear direction. The insertion hole 55 extends in the right-left direction. The insertion hole 55 has an almost rectangular shape as seen in front view.

Figure 4:
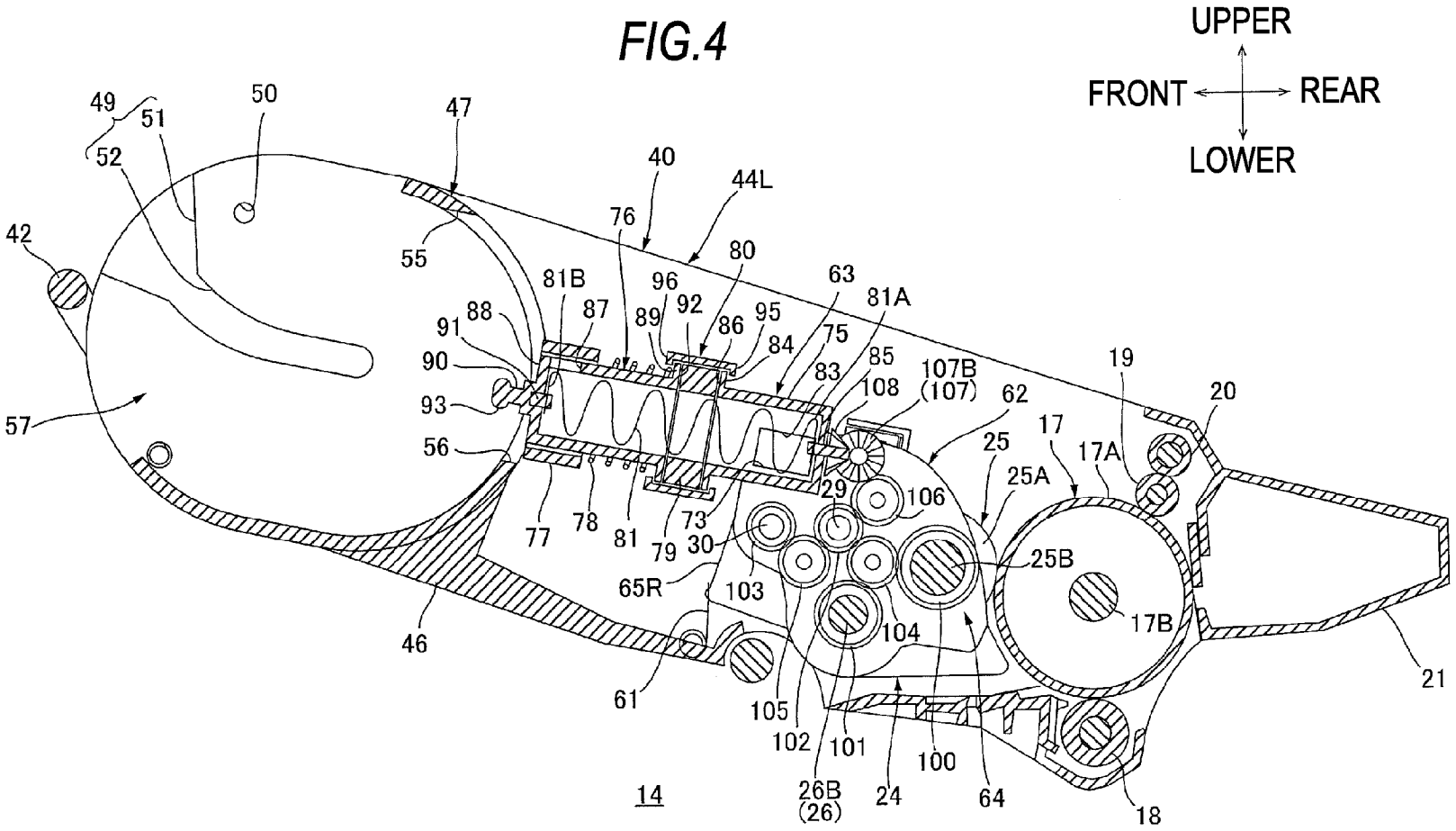
FIG. 4 is a cross-sectional view taken along line B-B of the drum cartridge illustrated in FIG. 2.

The notch 56 is positioned below the right of the insertion hole 55 as illustrated in FIGS. 2 and 4. The notch 56 is notched downward from a right lower end of the insertion hole 55. The notch 56 has an almost rectangular shape as seen in front view.

Although details will be described below, the toner cartridge 15 is mounted in front of the partition wall 47 in the frame 40. In this way, a portion, which is defined by the partition wall 47, the front of the lower wall 46, and the front of the sidewall 44R and the sidewall 44L, is a toner cartridge mounting portion 57 in the frame 40. That is, the guide portion 49 and the fixing hole 50 are provided in the toner cartridge mounting portion 57.

The drum handle 42 is positioned at a front end of the drum unit 14. The drum handle 42 is pivotally rotatable around a lower end between an upright position where the drum handle 42 is upright to extend upward and frontward and a tilt position (not illustrated) where it is tilted frontward from the upright position. The drum handle 42 is always biased toward the upright position by a biasing member (not illustrated).

(2) Photosensitive Drum

The photosensitive drum 17 includes a drum body 17A and a drum shaft 17B.

The drum body 17A is positioned at an outer circumferential part of the photosensitive drum 17 in a radial direction of the photosensitive drum 17. The drum body 17A extends in the right-left direction. The drum body 17A has a cylindrical shape in which both right and left ends are closed.

The drum shaft 17B is positioned at a center of the photosensitive drum 17 in the radial direction of the photosensitive drum 17. The drum shaft 17B extends in the right-left direction. The drum shaft 17B has a columnar shape. A right end of the drum shaft 17B protrudes rightward beyond a right end of the drum body 17A as illustrated in FIG. 2. The right end of the drum shaft 17B is inserted into the hole 58 of the sidewall 44R. Thus, the right end of the drum shaft 17B is rotatably supported by the sidewall 44R. The right end of the drum shaft 17B protrudes rightward beyond the sidewall 44R. A left end of the drum shaft 17B protrudes leftward beyond a left end of the drum body 17A. The left end of the drum shaft 17B is inserted into the hole 58 of the sidewall 44L. Thus, the left end of the drum shaft 17B is rotatably supported by the sidewall 44L. The left end of the drum shaft 17B protrudes leftward beyond the sidewall 44L.

(3) Developing Unit

As illustrated in FIGS. 3A and 4, the developing unit 24 is positioned at a substantially center of the drum unit 14 in the front-rear direction. The developing unit 24 includes a developing frame 62 that supports the developing roller 25 and the supply roller 26 described above, a first screw 29, a second screw 30, a conveyance portion 63, and a gear train 64.

(3-1) Developing Frame

As illustrated in FIGS. 2 and 3A, the developing frame 62 includes a right sidewall 65R having a first communication opening 73, a left sidewall 65L, a front wall 66, a lower wall 67, an upper wall 68, and a compartment wall 70.

The sidewall 65R is positioned at a right end of the developing frame 62. The sidewall 65R extends in the up-down direction and the front-rear direction. The sidewall 65R has a plate shape.

The first communication opening 73 is positioned at a rear upper end of the sidewall 65R as illustrated in FIGS. 3A and 4. The first communication opening 73 is positioned in front of the compartment wall 70 which will be described below. The first communication opening 73 penetrates through the sidewall 65R in the right-left direction.

The sidewall 65L is positioned at a left end of the developing frame 62 as illustrated in FIG. 2. The sidewall 65L extends in the up-down direction and the front-rear direction. The sidewall 65L has a plate shape.

The front wall 66 is positioned at a front end of the developing frame 62. The front wall 66 is positioned between a front end of the sidewall 65R and a front end of the sidewall 65L. The front wall 66 extends in the up-down direction and the right-left direction. The front wall 66 has a plate shape.

As illustrated in FIG. 3A, the lower wall 67 is positioned at a lower end of the developing frame 62. The lower wall 67 is positioned between a lower end of the sidewall 65R and a lower end of the sidewall 65L. The lower wall 67 extends in the front-rear direction and the right-left direction. The lower wall 67 has a plate shape. A front end of the lower wall 67 is connected to a lower end of the front wall 66.

As illustrated in FIGS. 2 and 3A, the upper wall 68 is positioned at an upper end of the developing frame 62. The upper wall 68 is positioned between an upper end of the sidewall 65R and an upper end of the sidewall 65L. The upper wall 68 extends in the front-rear direction and the right-left direction. A front end of the upper wall 68 is connected to an upper end of the front wall 66 as illustrated in FIG. 3A. A rear end of the upper wall 68 is bent downward. The rear end of the upper wall 68 supports the layer thickness regulation blade 27.

The compartment wall 70 is positioned in the rear of the front wall 66. The compartment wall 70 is positioned between the sidewall 65R and the sidewall 65L. The compartment wall 70 extends downward from a substantially center of the upper wall 68 in the front-rear direction. The compartment wall 70 has a plate shape. A lower end of the compartment wall 70 is positioned in front of the supply roller 26. The lower end of the compartment wall 70 is positioned above the lower wall 67 while keeping an interval.

The compartment wall 70 partitions the internal space of the developing frame 62 into a developing portion 31 positioned in the rear of the compartment wall 70 and a toner accommodating portion 28 positioned in front of the compartment wall 70.

(3-2) Developing Roller

As illustrated in FIGS. 2 and 3A, the developing roller 25 includes a covering portion 25A, a shaft 25B, a right collar 25CR, and a left collar 25CL.

The covering portion 25A is positioned at an outer circumferential part of the developing roller 25 in a radial direction of the developing roller 25. The covering portion 25A extends in the right-left direction. The covering portion 25A has a cylindrical shape.

The shaft 25B is positioned at a center of the developing roller 25 in the radial direction of the developing roller 25. The shaft 25B extends in the right-left direction. The shaft 25B has a columnar shape. A right end of the shaft 25B protrudes rightward beyond a right end of the covering portion 25A. The right end of the shaft 25B is rotatably supported by the sidewall 65R. The right end of the shaft 25B protrudes rightward beyond the sidewall 65R. A left end of the shaft 25B protrudes leftward beyond a left end of the covering portion 25A. The left end of the shaft 25B is rotatably supported by the sidewall 65L. The left end of the shaft 25B protrudes leftward beyond the sidewall 65L.

As illustrated in FIG. 2, the collar 25CR is positioned at the right end of the developing roller 25. The collar 25CR extends in the right-left direction. The collar 25CR has a cylindrical shape. The collar 25CR is fitted into the right end of the shaft 25B. Then, the collar 25CR is fitted into the first elongate hole 59 of the sidewall 44R. The collar 25CR protrudes outward in the right-left direction beyond the sidewall 44R.

As illustrated in FIGS. 2 and 3B, the collar 25CL is positioned at the left end of the developing roller 25. The collar 25CL extends in the right-left direction. The collar 25CL has a cylindrical shape. The collar 25CL is fitted into the left end of the shaft 25B. Then, the collar 25CL is fitted into the first elongate hole 59 of the sidewall 44L. The collar 25CL protrudes outward in the right-left direction beyond the sidewall 44L.

(3-3) Supply Roller

As illustrated in FIGS. 2 and 3A, the supply roller 26 includes a covering portion 26A, a shaft 26B, a right collar 26CR, and a left collar 26CL.

The covering portion 26A is positioned at an outer circumferential part of the supply roller 26 in a radial direction of the supply roller 26. The covering portion 26A extends in the right-left direction. The covering portion 26A has a cylindrical shape.

The shaft 26B is positioned at a center of the supply roller 26 in the radial direction of the supply roller 26. The shaft 26B extends in the right-left direction. The shaft 26B has a columnar shape. A right end of the shaft 26B protrudes rightward beyond a right end of the covering portion 26A. The right end of the shaft 26B is rotatably supported by the sidewall 65R. The right end of the shaft 26B protrudes rightward beyond the sidewall 65R. A left end of the shaft 26B protrudes leftward beyond a left end of the covering portion 26A. The left end of the shaft 26B is rotatably supported by the sidewall 65L. The left end of the shaft 26B protrudes leftward beyond the sidewall 65L.

As illustrated in FIG. 2, the collar 26CR is positioned at a right end of the supply roller 26. The collar 26CR extends in the right-left direction. The collar 26CR has a cylindrical shape. The collar 26CR is fitted into the right end of the shaft 26B. Then, the collar 26CR is fitted into the second elongate hole 60 of the sidewall 44R. The collar 26CR protrudes outward in the right-left direction beyond the sidewall 44R.

As illustrated in FIGS. 2 and 3B, the collar 26CL is positioned at a left end of the supply roller 26. The collar 26CL extends in the right-left direction. The collar 26CL has a cylindrical shape. The collar 26CL is fitted into the left end of the shaft 26B. Then, the collar 26CL is fitted into the second elongate hole 60 of the sidewall 44L. The collar 26CL protrudes outward in the right-left direction beyond the sidewall 44L.

(3-4) First Screw and Second Screw

As illustrated in FIG. 3A, the first screw 29 is positioned inside the developing portion 31. Specifically, the first screw 29 is positioned above the supply roller 26 and in the rear of the compartment wall 70. A right end of the first screw 29 is rotatably supported by the sidewall 65R. A left end of the first screw 29 is rotatably supported by the sidewall 65L.

The second screw 30 is positioned inside the toner accommodating portion 28. That is, the second screw 30 is positioned in front of the compartment wall 70. A right end of the second screw 30 is rotatably supported by the sidewall 65R. A left end of the second screw 30 is rotatably supported by the sidewall 65L.

(3-5) Conveyance Portion

As illustrated in FIGS. 2 and 4, the conveyance portion 63 is positioned at a front right end of the developing unit 24. The conveyance portion 63 includes the conveyance tube 75 having a second communication opening 83, the coupling tube 76 having a toner receiving port 87, a first shutter 77 as an example of a shutter, a biasing member 78, a buffer member 79, a cover member 80, and a coil spring 81 as an example of a conveyance member.

The conveyance tube 75 is positioned at a front right end of the conveyance portion 63. The conveyance tube 75 is fixed to the developing frame 62. The conveyance tube 75 extends in the front-rear direction. The conveyance tube 75 has a cylindrical shape in which a rear end is closed, as illustrated in FIG. 4. The conveyance tube 75 includes a first flange portion 84 and a first fastener 85.

The first flange portion 84 is positioned at a front end of the conveyance tube 75. The first flange portion 84 protrudes outward in a radial direction of the conveyance tube 75 from the front end of the conveyance tube 75. The first flange portion 84 extends in a circumferential direction of the conveyance tube 75. The first flange portion 84 has a plate shape. A front surface of the first flange portion 84 is a first bonding surface 86. The first bonding surface 86 extends in the radial direction of the conveyance tube 75. That is, the first bonding surface 86 extends in a direction that is approximately orthogonal to a moving direction of the conveyance tube 75. The expression "approximately orthogonal" means, for example, 75 degrees or more, preferably 80 degrees or more, and more preferably, 85 degrees or more, and means, for example, 105 degrees or less, preferably 100 degrees or less, and more preferably 95 degrees or less. Specifically, the expression "approximately orthogonal" means 90 degrees.

The first fastener 85 is positioned at a rear end of the conveyance tube 75. The first fastener 85 extends in the front-rear direction. The first fastener 85 has an almost columnar shape. The first fastener 85 is rotatably supported by the rear end of the conveyance tube 75. A front end of the first fastener 85 protrudes rearward from a rear wall of the conveyance tube 75.

The second communication opening 83 is positioned at the rear end of the conveyance tube 75. The second communication opening 83 penetrates through a left circumferential surface of the conveyance tube 75 in the right-left direction. The second communication opening 83 has an almost rectangular shape as seen in side view. The second communication opening 83 coincides in the right-left direction with the first communication opening 73 of the developing frame 62.

The coupling tube 76 is positioned in front of the conveyance tube 75 while keeping an interval. The coupling tube 76 extends in the front-rear direction, that is, the moving direction of the conveyance tube 75. The coupling tube 76 has an almost cylindrical shape in which a front end is closed. A front surface of the coupling tube 76 is a second contact surface 88. The second contact surface 88 extends in a radial direction of the coupling tube 76. That is, the second contact surface 88 extends in a direction approximately orthogonal to the moving direction of the conveyance tube 75.

In addition, the coupling tube 76 includes a second flange portion 89, a projection portion 90, and a second fastener 91.

The second flange portion 89 is positioned at a rear end of the coupling tube 76. The second flange portion 89 protrudes outward in a radial direction of the coupling tube 76 from the rear end of the coupling tube 76. The second flange portion 89 extends in a circumferential direction of the coupling tube 76. The second flange portion 89 has a plate shape. A rear surface of the second flange portion 89 is a second bonding surface 92. The second bonding surface 92 extends in the radial direction of the coupling tube 76. That is, the second bonding surface 92 extends in a direction approximately orthogonal to the moving direction of the conveyance tube 75.

The projection portion 90 is positioned at a front end of the coupling tube 76. The projection portion 90 protrudes frontward from the front end of the coupling tube 76. The projection portion 90 has an almost columnar shape. The projection portion 90 protrudes frontward beyond the partition wall 47 through the notch 56. The projection portion 90 is provided with a protrusion portion 93 as an example of a first protrusion portion.

The protrusion portion 93 is positioned at a front end of the projection portion 90. The protrusion portion 93 protrudes outward in a radial direction of the projection portion 90 from a circumferential surface of the projection portion 90. The protrusion portion 93 extends in a circumferential direction of the projection portion 90. The protrusion portion 93 has an almost arc shape as seen in cross-sectional view.

The second fastener 91 is positioned in the rear of the protrusion portion 93. The second fastener 91 extends in the front-rear direction. The second fastener 91 has an almost columnar shape. The second fastener 91 is rotatably supported by the front end of the coupling tube 76.

The toner receiving port 87 is positioned at the front end of the coupling tube 76. The toner receiving port 87 penetrates through an upper circumferential surface of the coupling tube 76 in the up-down direction. The toner receiving port 87 has an almost rectangular shape as seen in bottom surface view.

The first shutter 77 is positioned at the front end of the developing unit 24. The first shutter 77 covers the circumferential surface of the coupling tube 76. In other words, the first shutter 77 is provided on the coupling tube 76. The first shutter 77 extends in the front-rear direction. The first shutter 77 has an almost cylindrical shape. The dimension of the first shutter 77 in the front-rear direction is approximately half the dimension of the coupling tube 76 in the front-rear direction. The first shutter 77 is movable between a closed position (see FIG. 4) at which the toner receiving port 87 of the coupling tube 76 is closed and an open position (see FIG. 7) at which the toner receiving port 87 of the coupling tube 76 is open, the open position being positioned in the rear of the closed position.

The biasing member 78 is positioned in the rear of the first shutter 77. The biasing member 78 is wound around the coupling tube 76. The biasing member 78 is a coil spring extending in the front-rear direction. A front end of the biasing member 78 comes in contact with a rear end of the first shutter 77. A rear end of the biasing member 78 comes in contact with a front surface of the second flange portion 89. The biasing member 78 is configured to position the first shutter 77 at the closed position in a state of the natural length.

The buffer member 79 is positioned between the first flange portion 84 and the second flange portion 89. The buffer member 79 is urethane foam. In addition, polyethylene foam or a rubber sponge can be substituted for the buffer member 79. The buffer member 79 is deformable. The buffer member 79 has an almost annular shape. A rear surface of the buffer member 79 is bonded to the first bonding surface 86 of the first flange portion 84. A front surface of the buffer member 79 is bonded to the second bonding surface 92 of the second flange portion 89. Thus, a region between the conveyance tube 75 and the coupling tube 76 is sealed with the buffer member 79. The buffer member 79 is maintained between the first flange portion 84 and the second flange portion 89 in a state of being compressed in the front-rear direction.

The cover member 80 is positioned outside in a radial direction of the buffer member 79. The cover member 80 extends in the front-rear direction. The cover member 80 has an almost cylindrical shape. A rear end of the cover member 80 is positioned rearward from the first flange portion 84 of the conveyance tube 75. A front end of the cover member 80 is positioned in front of the second flange portion 89 of the coupling tube 76. The cover member 80 includes a first regulation portion 95 and a second regulation portion 96.

The first regulation portion 95 is positioned at the rear end of the cover member 80. The first regulation portion 95 protrudes inward in a radial direction of the cover member 80. The first regulation portion 95 extends in a circumferential direction of the cover member 80. The cover member 80 has a plate shape. A front surface of the first regulation portion 95 faces a rear surface of the first flange portion 84 of the conveyance tube 75. A rear surface of the first flange portion 84 of the conveyance tube 75 is pressed against the front surface of the first regulation portion 95 by an elastic force of the buffer member 79 that is compressed in the front-rear direction.

The second regulation portion 96 is positioned at the front end of the cover member 80. The second regulation portion 96 protrudes inward in the radial direction of the cover member 80. The second regulation portion 96 extends in the circumferential direction of the cover member 80. The second regulation portion 96 has a plate shape. A rear surface of the second regulation portion 96 faces the front surface of the second flange portion 89 of the coupling tube 76. The front surface of the second flange portion 89 of the coupling tube 76 is pressed against the rear surface of the second regulation portion 96 by the elastic force of the buffer member 79 that is compressed in the front-rear direction.

In this way, the coupling tube 76 is connected to the conveyance tube 75 by the cover member 80 and the buffer member 79.

The coil spring 81 is positioned inside the conveyance tube 75 and the coupling tube 76. In other words, at least a part of the coil spring 81 is positioned inside the coupling tube 76. The coil spring 81 is flexible. A rear end 81A of the coil spring 81 is positioned at the rear end of the conveyance tube 75. The rear end 81A of the coil spring 81 is an example of a first end. The rear end 81A of the coil spring 81 is connected to the first fastener 85 of the conveyance tube 75. That is, the rear end 81A of the coil spring 81 is rotatably supported by the conveyance tube 75. A front end 81B of the coil spring 81 is positioned at the front end of the coupling tube 76. The front end 81B of the coil spring 81 is an end opposite to the rear end 81A in the front-rear direction. The front end 81B of the coil spring 81 is an example of a second end. The front end 81B of the coil spring 81 is connected to the second fastener 91 of the coupling tube 76. That is, the front end 81B of the coil spring 81 is rotatably supported by the coupling tube 76. As a result, the coil spring 81 is rotatable in the conveyance tube 75 and the coupling tube 76.

(3-6) Gear Train

As illustrated in FIGS. 2 and 4, the gear train 64 is positioned at the right end of the developing unit 24. The gear train 64 includes a developing gear 100, a supply gear 101, a first screw gear 102, a second screw gear 103, a first idle gear 104, a second idle gear 105, a third idle gear 106, a first bevel gear 107, and a second bevel gear 108.

The developing gear 100 is fixed to the right end of the shaft 25B. The developing gear 100 has gear teeth around the entire circumference. The developing gear 100 is rotatable with the shaft 25B.

The supply gear 101 is positioned at a front lower side of the developing gear 100. The supply gear 101 is fixed to the right end of the shaft 26B. The supply gear 101 has gear teeth around the entire circumference. The supply gear 101 is rotatable with the shaft 26B.

The first screw gear 102 is positioned above the supply gear 101 as illustrated in FIG. 4. The first screw gear 102 is fixed to a right end of a shaft of the first screw 29. The first screw gear 102 has gear teeth around the entire circumference. The first screw gear 102 is rotatable with the first screw 29.

The second screw gear 103 is positioned in front of the first screw gear 102. The second screw gear 103 is fixed to a right end of a shaft of the second screw 30. The second screw gear 103 has gear teeth around the entire circumference. The second screw gear 103 is rotatable with the second screw 30.

The first idle gear 104 is positioned in front of the developing gear 100 and at a rear upper side of the supply gear 101. The first idle gear 104 is rotatably supported by the sidewall 65R of the developing frame 62. The first idle gear 104 has gear teeth around the entire circumference. The first idle gear 104 is engaged with the developing gear 100 and the supply gear 101.

The second idle gear 105 is positioned at a front lower side of the first screw gear 102 and at a rear lower side of the second screw gear 103. The second idle gear 105 is rotatably supported by the sidewall 65R of the developing frame 62. The second idle gear 105 has gear teeth around the entire circumference. The second idle gear 105 is engaged with the first screw gear 102 and the second screw gear 103.

The third idle gear 106 is positioned above the first screw gear 102. The third idle gear 106 is rotatably supported by the sidewall 65R of the developing frame 62. The third idle gear 106 has gear teeth around the entire circumference. The third idle gear 106 is engaged with the first screw gear 102.

The first bevel gear 107 is positioned at a front upper side of the third idle gear 106. The first bevel gear 107 is rotatably supported by the sidewall 65R of the developing frame 62. The first bevel gear 107 has a columnar portion 107A and a bevel portion 107B as illustrated in FIG. 2.

The columnar portion 107A is positioned at a left end of the first bevel gear 107. The columnar portion 107A extends in the right-left direction. The columnar portion 107A has gear teeth around the entire circumference. The columnar portion 107A is engaged with the third idle gear 106.

The bevel portion 107B is positioned at a right end of the first bevel gear 107 as illustrated in FIGS. 2 and 4. The bevel portion 107B has a conical shape in which a diameter becomes smaller toward the right. The bevel portion 107B has gear teeth on the circumferential surface of the conical part.

The second bevel gear 108 is positioned at a front right of the first bevel gear 107 and in the rear of the conveyance portion 63. The second bevel gear 108 is fixed to the rear end of the first fastener 85 of the conveyance portion 63. The second bevel gear 108 has a conical shape in which a diameter becomes smaller toward the rear. The second bevel gear 108 has gear teeth on the circumferential surface of the conical part. The second bevel gear 108 is engaged with the bevel portion 107B of the first bevel gear 107.

(4) Assembly State of Developing Unit with Respect to Drum Cartridge

As described above, the developing unit 24 is supported by the frame 40 of the drum unit 14 as illustrated in FIGS. 2 and 3B in such a manner that the collar 25CR is fitted into the first elongate hole 59 of the sidewall 44R, the collar 25CL is fitted into the first elongate hole 59 of the sidewall 44L, the collar 26CR is fitted into the second elongate hole 60 of the sidewall 44R, and the collar 26CL is fitted into the second elongate hole 60 of the sidewall 44L of the drum unit 14. Thus, the developing unit 24 is movable along the first elongate hole 59 and the second elongate hole 60 in the front-rear direction. That is, the conveyance tube 75 of the developing unit 24 moves in the front-rear direction. In addition, the conveyance tube 75 moves in a direction substantially equal to the arrangement direction of the photosensitive drum 17 and the developing roller 25.

The front lower end of the sidewall 65R of the developing unit 24 comes in contact with a rear surface of a free end of the right spring 61. The front lower end of the sidewall 65L of the developing unit 24 comes in contact with a free end of the left spring 61. Thereby, the developing unit 24 is always pressed rearward along the first elongate hole 59 and the second elongate hole 60 by two springs 61. In other words, the extending direction of the first elongate hole 59 and the second elongate hole 60 is a pressing direction of the spring 61.

3. Toner Cartridge (1) Structure of Toner Cartridge

Figure 5:
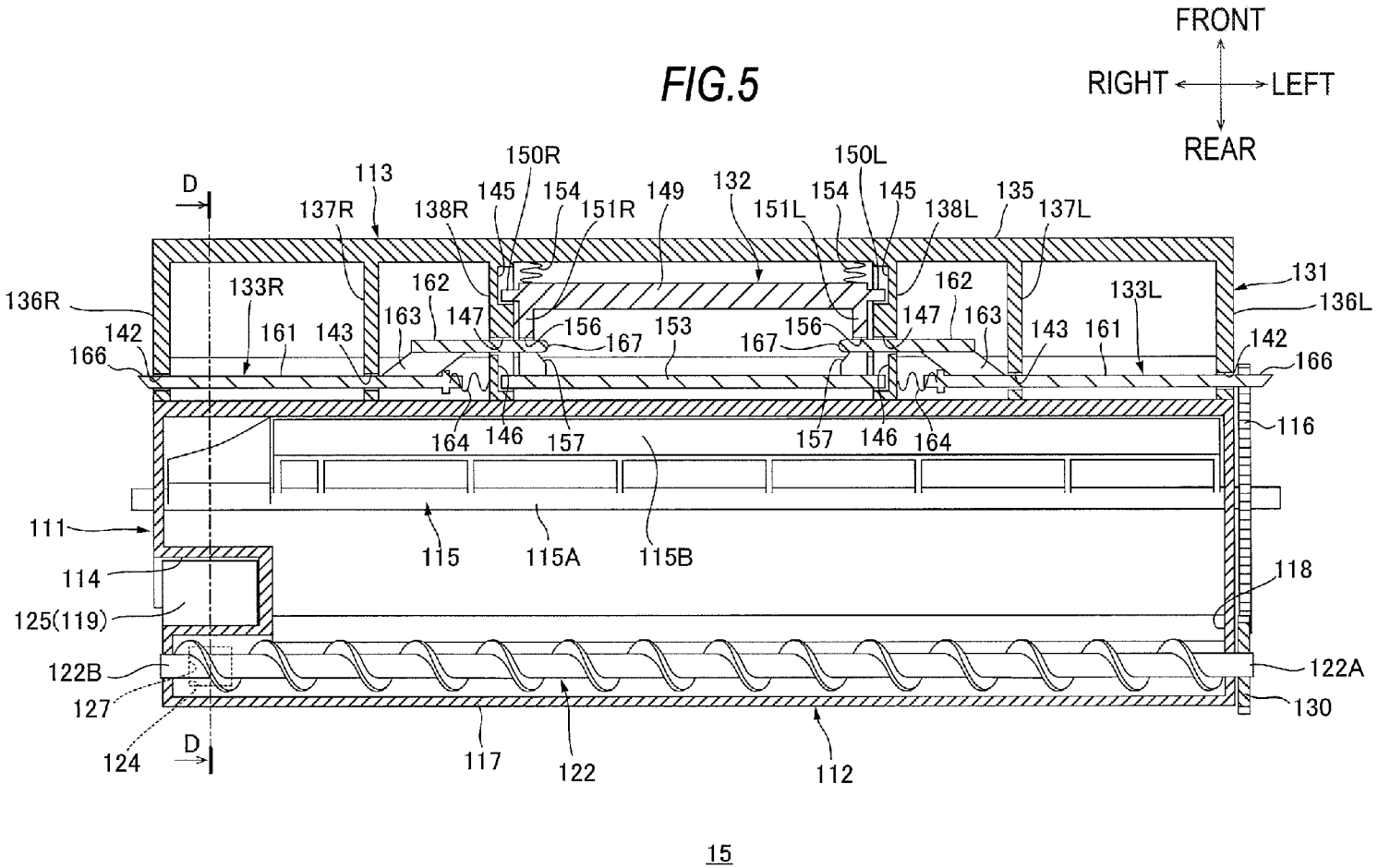
FIG. 5 is a cross-sectional view taken along line C-C of a toner cartridge illustrated in FIG. 10.
Figure 6:
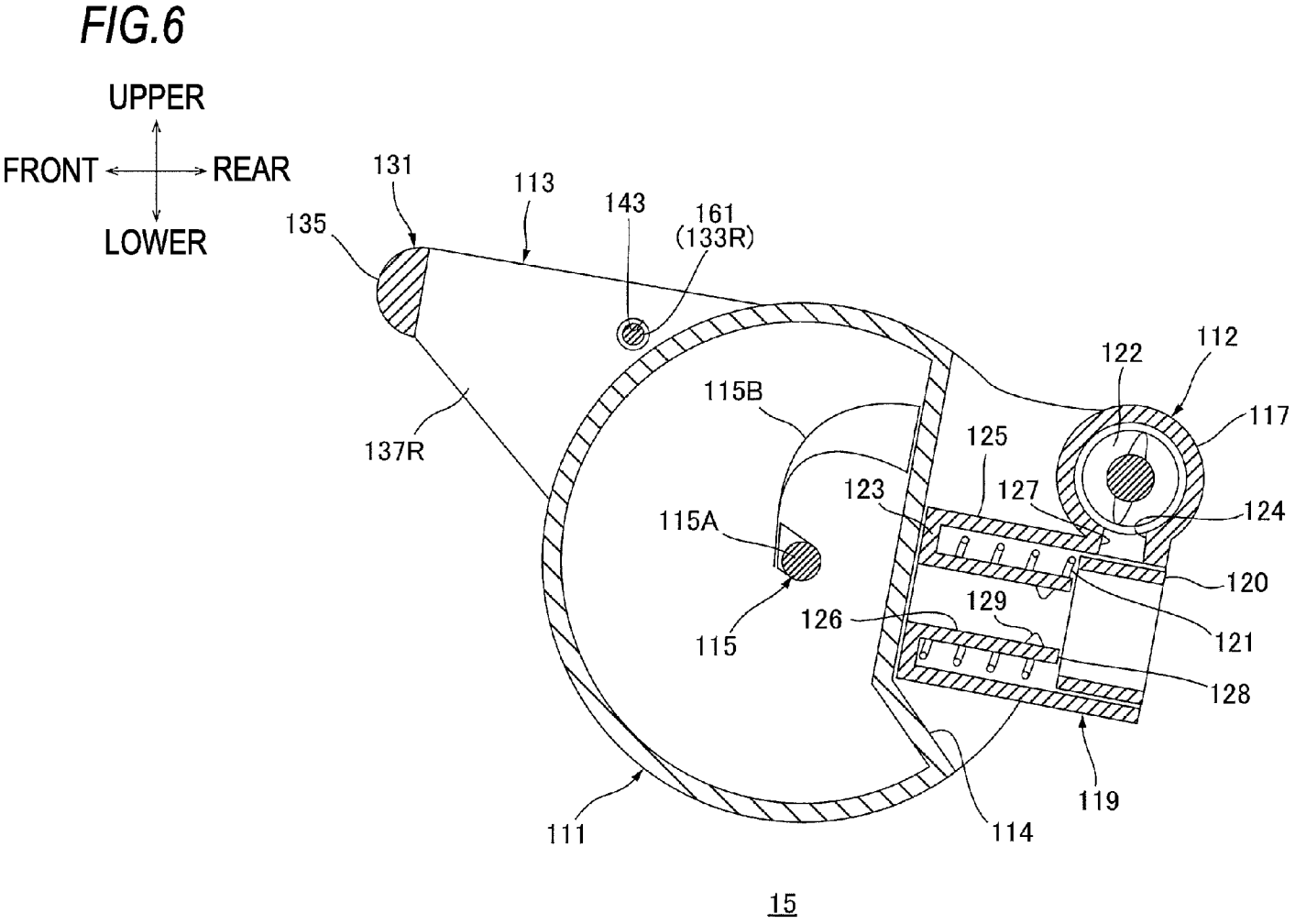
FIG. 6 is a cross-sectional view taken along line D-D of a toner cartridge illustrated in FIG. 5.

As illustrated in FIGS. 5 and 6, the toner cartridge 15 includes a toner accommodating portion 111, a supply portion 112, and a handle unit 113.

(1-1) Toner Accommodating Portion

The toner accommodating portion 111 accommodates a toner therein.

The toner accommodating portion 111 extends in the right-left direction. The toner accommodating portion 111 has an almost cylindrical shape in which both right and left ends are closed. The toner accommodating portion 111 includes a stepped portion 114 and an agitator 115.

The stepped portion 114 is positioned at a right rear end of the toner accommodating portion 111. The stepped portion 114 is recessed toward a front left from the right rear end of the toner accommodating portion 111.

The agitator 115 includes an agitator shaft 115A, a blade 115B, and an agitator gear 116.

The agitator shaft 115A is positioned at a center of the toner accommodating portion 111 as seen in the right-left direction. The agitator shaft 115A extends in the right-left direction. The agitator shaft 115A has a columnar shape. A right end of the agitator shaft 115A is rotatably supported by a right end of the toner accommodating portion 111. The right end of the agitator shaft 115A protrudes rightward beyond the right end of the toner accommodating portion 111. A left end of the agitator shaft 115A is rotatably supported by a left end of the toner accommodating portion 111. The left end of the agitator shaft 115A protrudes leftward beyond the left end of the toner accommodating portion 111.

The blade 115B is positioned within the toner accommodating portion 111. The blade 115B extends outward in a radial direction of the agitator 115 from the agitator shaft 115A. The blade 115B comes in contact with an inner surface of the toner accommodating portion 111.

The agitator gear 116 is positioned to left of the toner accommodating portion 111. The agitator gear 116 is fixed to the left end of the agitator shaft 115A. The agitator gear 116 has gear teeth around the entire circumference. The agitator gear 116 is rotatable with the agitator shaft 115A.

(1-2) Supply Portion

The supply portion 112 is positioned at a rear end of the toner cartridge 15. The supply portion 112 is fixed to the toner accommodating portion 111. The supply portion 112 includes a supply tube 117 having a communication opening 118 and a toner supply port 124, a receiving portion 119, a second shutter 120, a biasing member 121, and an auger screw 122.

As illustrated in FIGS. 1 and 5, the supply tube 117 is positioned in the rear of the toner accommodating portion 111. The supply tube 117 extends in the right-left direction. The supply tube 117 has an almost cylindrical shape in which both right and left ends are closed. A right end of the supply tube 117 overlaps with the stepped portion 114 as seen in the front-rear direction.

The communication opening 118 penetrates through a front end of the supply tube 117 and a rear upper end of the toner accommodating portion 111 in the front-rear direction. The communication opening 118 extends in the right-left direction. Thus, the communication opening 118 communicates with the front end of the supply tube 117 and the rear upper end of the toner accommodating portion 111.

As illustrated in FIGS. 5 and 6, the toner supply port 124 is positioned at a right end of the supply tube 117. The toner supply port 124 penetrates through a lower circumferential surface of the supply tube 117 in the up-down direction. The toner supply port 124 has an almost rectangular shape as seen from the bottom surface.

The receiving portion 119 is positioned below the right of the supply tube 117. The receiving portion 119 includes an outer cylinder portion 125 having the communication opening 127, an inner cylinder portion 126 as an example of a recess portion, and a closed portion 123.

The outer cylinder portion 125 is positioned below the toner supply port 124 of the supply tube 117. A front end of the outer cylinder portion 125 is positioned inside the stepped portion 114 of the toner accommodating portion 111. The outer cylinder portion 125 extends in the front-rear direction. The outer cylinder portion 125 has an almost cylindrical shape.

The communication opening 127 is positioned at a rear end of the outer cylinder portion 125. The communication opening 127 penetrates through an upper circumferential surface of the outer cylinder portion 125 in the up-down direction. The communication opening 127 coincides in the up-down direction with the toner supply port 124 of the supply tube 117.

The inner cylinder portion 126 is positioned inward in a radial direction of the outer cylinder portion 125 as illustrated in FIG. 6. The inner cylinder portion 126 extends in the front-rear direction. The inner cylinder portion 126 has a cylindrical shape. The dimension of the inner cylinder portion 126 in the front-rear direction is approximately two-thirds of the dimension of the outer cylinder portion 125 in the front-rear direction. A front end of the inner cylinder portion 126 coincides with a front end of the outer cylinder portion 125 as viewed in the right-left direction. A rear surface of the inner cylinder portion 126 is a first contact surface 128. The first contact surface 128 extends in a circumferential direction of the inner cylinder portion 126. That is, the first contact surface 128 extends in a direction orthogonal substantially to the moving direction of the conveyance tube 75.

In addition, the inner cylinder portion 126 includes a plate spring 129 as an example of a second protrusion portion.

The plate spring 129 is positioned at a rear end of the inner cylinder portion 126. The plate spring 129 protrudes inward in a radial direction of the inner cylinder portion 126 from an inner circumferential surface of the inner cylinder portion 126.

The closed portion 123 is positioned at a front end of the receiving portion 119. The closed portion 123 closes a space between the front end of the outer cylinder portion 125 and the front end of the inner cylinder portion 126. The closed portion 123 extends in the circumferential direction of the outer cylinder portion 125 and the inner cylinder portion 126. The closed portion 123 has a plate shape.

The second shutter 120 is positioned inward in the radial direction of outer cylinder portion 125. The second shutter 120 extends in the front-rear direction. The second shutter 120 has a cylindrical shape. An outer diameter of the second shutter 120 is smaller than an inner diameter of the outer cylinder portion 125. An inner diameter of the second shutter 120 is larger than an outer diameter of the inner cylinder portion 126. The second shutter 120 is positioned between the outer cylinder portion 125 and the inner cylinder portion 126 and is movable between a closed position (see FIG. 6) at which the toner supply port 124 and the communication opening 127 are closed and an open position (see FIG. 7) at which the toner supply port 124 and the communication opening 127 is open, the open position being positioned in front of the closed position.

The biasing member 121 is positioned in front of the second shutter 120. The biasing member 121 is positioned between the outer cylinder portion 125 and the inner cylinder portion 126. The biasing member 121 is a coil spring extending in the front-rear direction. A rear end of the biasing member 121 comes in contact with a front end of the second shutter 120. A front end of the biasing member 121 comes in contact with a rear surface of the closed portion 123 of the receiving portion 119. The biasing member 121 is configured to position the second shutter 120 at the closed position in a state of the natural length.

The auger screw 122 is positioned within the supply tube 117 as illustrated in FIGS. 5 and 6. The auger screw 122 extends in the right-left direction. A left end 122A of the auger screw 122 is rotatably supported by a left wall of the supply tube 117. The left end 122A of the auger screw 122 protrudes leftward beyond the left wall of the supply tube 117. A right end 122B of the auger screw 122 is rotatably supported by a right wall of the supply tube 117. The right end 122B of the auger screw 122 is an end opposite to the left end 122A in the right-left direction. The auger screw 122 includes a conveyance gear 130.

The conveyance gear 130 is positioned to the left of the supply tube 117. The conveyance gear 130 is fixed to the left end 122A of the auger screw 122. The conveyance gear 130 has gear teeth around the entire circumference. The conveyance gear 130 is rotatable with the auger screw 122. The conveyance gear 130 is engaged with the agitator gear 116.

(1-3) Handle Unit

As illustrated in FIGS. 5 and 6, the handle unit 113 is positioned at the front end of the toner cartridge 15. The handle unit 113 includes a stationary handle 131, a movable handle 132, a right interlocking portion 133R, and a left interlocking portion 133L.

The stationary handle 131 includes: a first grip 135; a first wall 136R positioned to the right and having a hole 142 into which the first rod 161 (which will be described below) of the interlocking portion 133R is inserted; a first wall 136L positioned to the left and having the hole 142 into which the first rod 161 (which will be described below) of the interlocking portion 133L is inserted; a second wall 137R positioned to the right and having a hole 143 into which the first rod 161 (which will be described below) of the interlocking portion 133R is inserted; a second wall 137L positioned to the left and having the hole 143 into which the first rod 161 (which will be described below) of the interlocking portion 133L is inserted; a third wall 138R positioned to the right and having a first groove 145, a second groove 146, and a hole 147 into which a second rod 162 (which will be described below) of the interlocking portion 133R is inserted; and a third wall 138L positioned to the left and having the first groove 145, the second groove 146, and the hole 147 into which the second rod 162 (which will be described below) of the interlocking portion 133L is inserted.

The first grip 135 is positioned at a front end of the stationary handle 131. The first grip 135 extends in the right-left direction. The first grip 135 has an almost cross section of a semi-circular shape protruding frontward.

The first wall 136R is positioned at a right end of the stationary handle 131. The first wall 136R extends frontward from the front end of the toner accommodating portion 111. The first wall 136R has an almost triangular shape in which the dimension in the up-down direction becomes smaller toward the front as seen in side view. The front end of the first wall 136R is connected to a right end of the first grip 135.

The hole 142 is positioned at a rear end of the first wall 136R. The hole 142 penetrates through the first wall 136R in the right-left direction. The hole 142 has a circular shape as seen in side view.

The first wall 136L is positioned at a left end of the stationary handle 131. The first wall 136L extends frontward from the front end of the toner accommodating portion 111. The first wall 136L has the same shape as the first wall 136R as projecting in the right-left direction. A front end of the first wall 136L is connected to a left end of the first grip 135.

The second wall 137R is positioned to the left of the first wall 136R. The second wall 137R extends frontward from the front end of the toner accommodating portion 111. The second wall 137R has the same shape as the first wall 136R as projecting in the right-left direction. A front end of the second wall 137R is connected to the first grip 135.

The hole 143 is positioned at a rear end of the second wall 137R. The hole 143 penetrates through the second wall 137R in the right-left direction. The hole 143 has an almost circular shape as seen in side view. The hole 143 coincides with the hole 142 of the first wall 136R as projecting in the right-left direction.

The second wall 137L is positioned to the right of the first wall 136L. The second wall 137L extends frontward from the front end of the toner accommodating portion 111. The second wall 137L has the same shape as the second wall 137R as projecting in the right-left direction. A front end of the second wall 137L is connected to the first grip 135.

The third wall 138R is positioned to the left of the second wall 137R. The third wall 138R extends frontward from the front end of the toner accommodating portion 111. The third wall 138R has the same shape as the first wall 136R as projecting in the right-left direction. A front end of the third wall 138R is connected to the first grip 135.

The first groove 145 is positioned at a front end of the third wall 138R. The first groove 145 is recessed outward in the right-left direction from the right/left inner surface of the third wall 138R. The first groove 145 extends in the front-rear direction. The first groove 145 has substantially rectangular shape as seen in side view.

The second groove 146 is positioned in the rear of the first groove 145. The second groove 146 is recessed outward in the right-left direction from the right/left inner surface of the third wall 138R. The second groove 146 extends in the front-rear direction. The second groove 146 has substantially rectangular shape as seen in side view.

The hole 147 is positioned at a front end of the second groove 146. The hole 147 penetrates through the third wall 138R in the right-left direction. The hole 147 has an almost rectangular shape as seen in side view.

The third wall 138L is positioned to the right of the second wall 137L. The third wall 138L extends frontward from the front end of the toner accommodating portion 111. The third wall 138L has the same shape as the first wall 136R as projecting in the right-left direction. A front end of the third wall 138L is connected to the first grip 135.

As illustrated in FIG. 5, the movable handle 132 is positioned at a substantially center of the handle unit 113 in the right-left direction. Specifically, the movable handle 132 is positioned between the third wall 138R and the third wall 138L in the right-left direction and between the toner accommodating portion 111 and the first grip 135 in the front-rear direction. The movable handle 132 includes a second grip 149, a right boss 150R, a left boss 150L, a fourth wall 151R positioned to the right and having a hole 156 into which the second rod 162 (which will be described below) of the interlocking portion 133R is inserted, a fourth wall 151L positioned to the left and having the hole 156 into which the second rod 162 (which will be described below) of the interlocking portion 133L is inserted, a coupling portion 153, and two biasing members 154.

The second grip 149 is positioned at a front end of the movable handle 132. The second grip 149 extends in the right-left direction. The second grip 149 has an almost cross section of a semi-circular shape protruding rearward.

The boss 150R is positioned to the right of the second grip 149. The boss 150R protrudes rightward beyond the right end of the second grip 149. The boss 150R has a columnar shape. The boss 150R is fitted into the first groove 145 of the third wall 138R.

The boss 150L is positioned to the left of the second grip 149. The boss 150L protrudes leftward beyond the left end of the second grip 149. The boss 150L is fitted into the first groove 145 of the third wall 138L.

Figure 8:
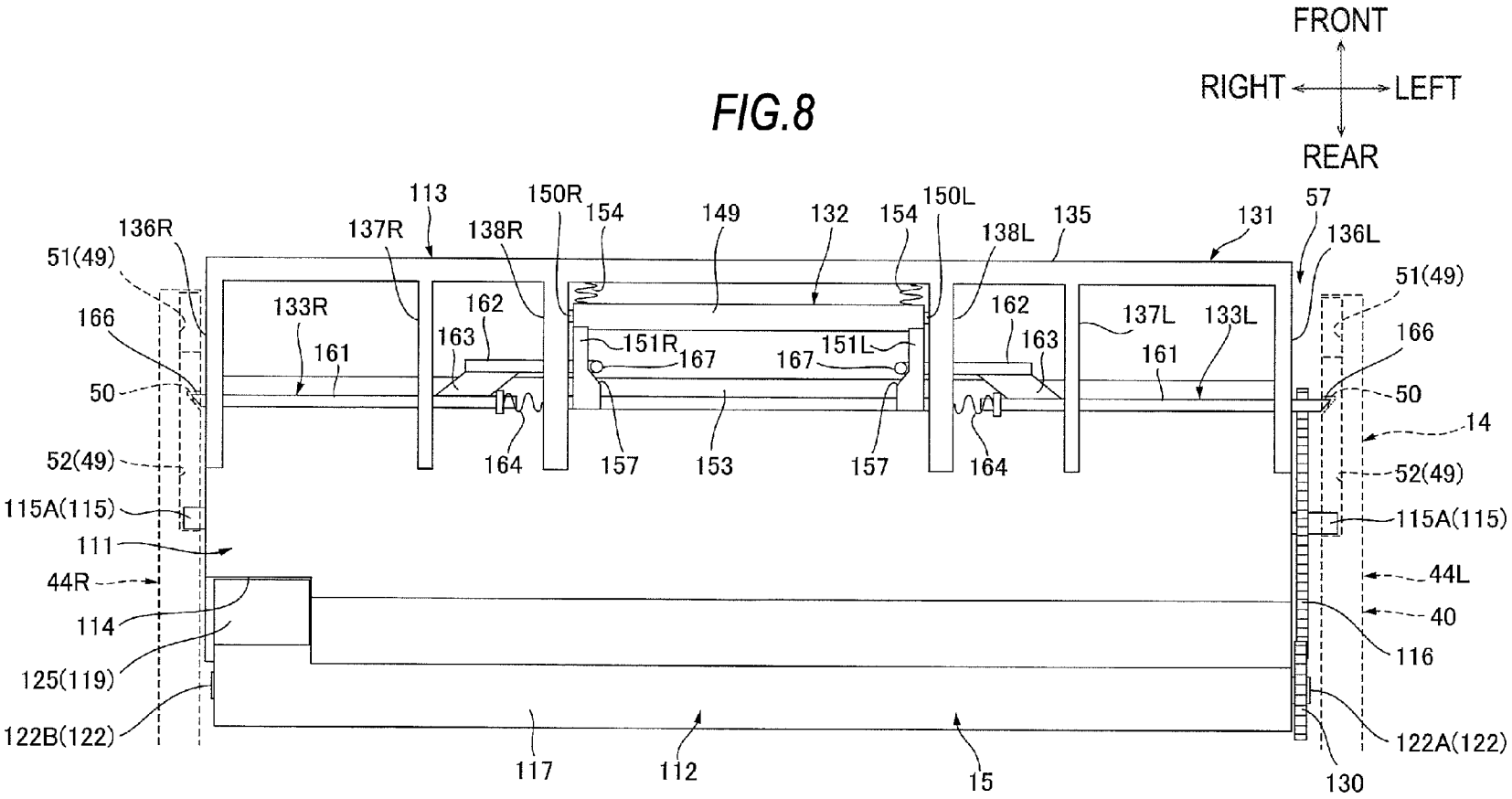
FIG. 8 is a diagram illustrating a state where a movable handle of the toner cartridge is positioned at a first position in a process cartridge illustrated in FIG. 1.

The fourth wall 151R is positioned at a right end of the movable handle 132 as illustrated in FIGS. 5 and 8. The fourth wall 151R is positioned to the left of the third wall 138R. The fourth wall 151R extends in the front-rear direction. The fourth wall 151R has a plate shape. A front end of the fourth wall 151R is connected to the right end of the second grip 149. The fourth wall 151R has an inclined portion 157.

The inclined portion 157 is positioned at a rear end of the fourth wall 151R. The inclined portion 157 is inclined inward in the right-left direction toward the rear from the right/left inner surface of the fourth wall 151R.

As illustrated in FIG. 5, the hole 156 is positioned to the rear of the fourth wall 151R. The hole 156 penetrates through the fourth wall 151R in the right-left direction. The hole 156 has an almost rectangular shape as seen in side view. The hole 156 overlaps with the inclined portion 157.

As illustrated in FIGS. 5 and 8, the fourth wall 151L is positioned at a left end of the movable handle 132. The fourth wall 151L is positioned to the right of the third wall 138L. The fourth wall 151L extends in the front-rear direction. The fourth wall 151L has a plate shape. A front end of the fourth wall 151L is connected to the left end of the second grip 149. Similarly to the fourth wall 151R, the fourth wall 151L has an inclined portion 157.

The coupling portion 153 is positioned at the rear end of the movable handle 132 as illustrated in FIG. 5. The coupling portion 153 extends in the right-left direction. The coupling portion 153 has a columnar shape. The coupling portion 153 is connected to the rear end of the fourth wall 151R and the rear end of the fourth wall 151L. A right end of the coupling portion 153 protrudes rightward beyond the fourth wall 151R. The right end of the coupling portion 153 is fitted into the second groove 146 of the third wall 138R. A left end of the coupling portion 153 protrudes leftward beyond the fourth wall 151L. The left end of the coupling portion 153 is fitted into the second groove 146 of the third wall 138L.

The two biasing members 154 are positioned between the second grip 149 and the first grip 135 of the stationary handle 131. The two biasing members 154 are spaced apart from each other with an interval in the right-left direction. Each of the biasing members 154 is a coil spring extending in the front-rear direction. A front end of the biasing member 154 comes in contact with the rear surface of the first grip 135. A rear end of the biasing member 154 comes in contact with the front surface of the second grip 149. The biasing member 154 always applies rearward a force such that the movable handle 132 is separated from the first grip 135.

Figure 9:
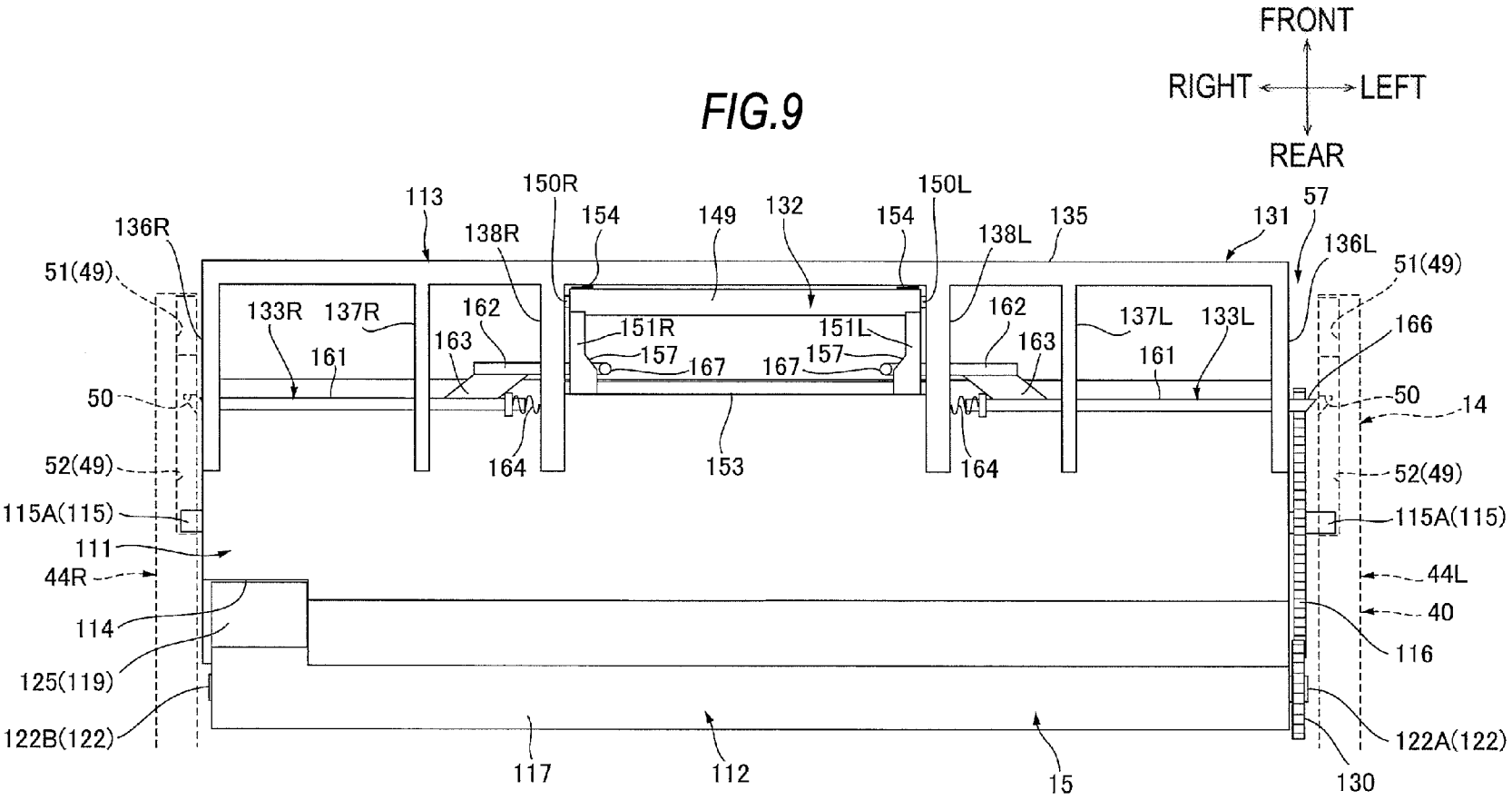
FIG. 9 is a diagram illustrating a state where the movable handle of the toner cartridge is positioned at a second position in the process cartridge illustrated in FIG. 1.

In this way, the movable handle 132 is movable between a first position (see FIG. 8) and a second position (see FIG. 9). In the a first position, the boss 150R is positioned at the rear end of the first groove 145 of the third wall 138R; the boss 150L is positioned at the rear end of the first groove 145 of the third wall 138L; the right end of the coupling portion 153 is positioned at the rear end of the second groove 146 of the third wall 138R; and the left end of the coupling portion 153 is positioned at the rear end of the second groove 146 of the third wall 138L, by a biasing force of the biasing members 154. In a second position (see FIG. 9), the boss 150R is positioned at the front end of the first groove 145 of the third wall 138R; the boss 150L is positioned at the front end of the first groove 145 of the third wall 138L; the right end of the coupling portion 153 is positioned at the front end of the second groove 146 of the third wall 138R; and the left end of the coupling portion 153 is positioned at the front end of the second groove 146 of the third wall 138L, against the biasing force of the biasing members 154.

As illustrated in FIG. 5, the interlocking portion 133R is positioned at a right end of the handle unit 113. The interlocking portion 133R includes the first rod 161, the second rod 162, the connection portion 163, and the biasing member 164, as an example of a fixing portion.

The first rod 161 is positioned at a rear end of the interlocking portion 133R. The first rod 161 extends in the right-left direction. The first rod 161 has a columnar shape. An outer end in the right-left direction of the first rod 161 is cut out inward in the right-left direction so as to be inclined rearward. The first rod 161 is inserted into the hole 142 of the first wall 136R and the hole 143 of the second wall 137R. The outer end in the right-left direction of the first rod 161 is positioned outward in the right-left direction from the first wall 136R. In the outer end in the right-left direction of the first rod 161, a front circumferential surface is a fixing surface 166. The fixing surface 166 extends in the right-left direction. In other words, that is, the fixing surface 166 extends in a direction orthogonal substantially to the moving direction of the conveyance tube 75. An inner end in the right-left direction of the first rod 161 is positioned between the second wall 137R and the third wall 138R.

The second rod 162 is positioned at a front end of the interlocking portion 133R. The second rod 162 extends in the right-left direction. The second rod 162 has an almost rectangular column shape. The second rod 162 is inserted into the hole 147 of the third wall 138R and the hole 156 of the fourth wall 151R of the movable handle 132. An outer end in the right-left direction of the second rod 162 is positioned between the second wall 137R and the third wall 138R. An inner end in the right-left direction of the second rod 162 is positioned inward in the right-left direction from the fourth wall 151R of the movable handle 132. The second rod 162 has a boss 167.

The boss 167 is positioned at the inner end in the right-left direction of the second rod 162. The boss 167 extends in the up-down direction. The boss 167 has a columnar shape. The dimension in the up-down direction of the boss 167 is larger than that of the hole 156 of the fourth wall 151R.

The connection portion 163 connects the inner end in the right-left direction of the first rod 161 and the outer end in the right-left direction of the second rod 162. The connection portion 163 has a plate shape. The connection portion 163 is inclined outward in the right-left direction toward the rear.

The biasing member 164 is positioned at the inner end in the right-left direction of the first rod 161. The biasing member 164 is a coil spring extending in the right-left direction. An outer end in the right-left direction of the biasing member 164 is fixed to the outer end in the right-left direction of the first rod 161. The inner end in the right-left direction of the biasing member 164 is fixed to an outer surface in the right-left direction of the third wall 138R. The biasing member 164 always presses outward the interlocking portion 133R in the right-left direction.

In this way, the interlocking portion 133R is movable between a first lock position (see FIG. 8) and an unlock position (see FIG. 9). In the first lock position, the outer rear end in the right-left direction of the connection portion 163 comes in contact with the second wall 137R by the biasing force of the biasing member 164 and the outer end in the right-left direction of the first rod 161 is positioned outward in the right-left direction from the first wall 136R. In the unlock position, the outer rear end in the right-left direction of the connection portion 163 is spaced from the second wall 137R against the biasing force of the biasing member 164 and the outer end in the right-left direction of the first rod 161 is positioned at a position overlapping with the first wall 136R as projecting in the up-down direction.

The interlocking portion 133L is positioned at the left end of the handle unit 113. The interlocking portion 133L has the same shape as the interlocking portion 133R.

When the interlocking portion 133L is positioned in the lock position, the outer end in the right-left direction of the first rod 161 of the interlocking portion 133L is positioned outward in the right-left direction from the agitator gear 116 as illustrated in FIG. 8. Furthermore, when the interlocking portion 133L is positioned in the unlock position, as illustrated in FIG. 9, the outer end in the right-left direction of the first rod 161 of the interlocking portion 133L overlaps with the agitator gear 116 as projecting in the up-down direction.

(2) Mounting State of Toner Cartridge

Figure 7:
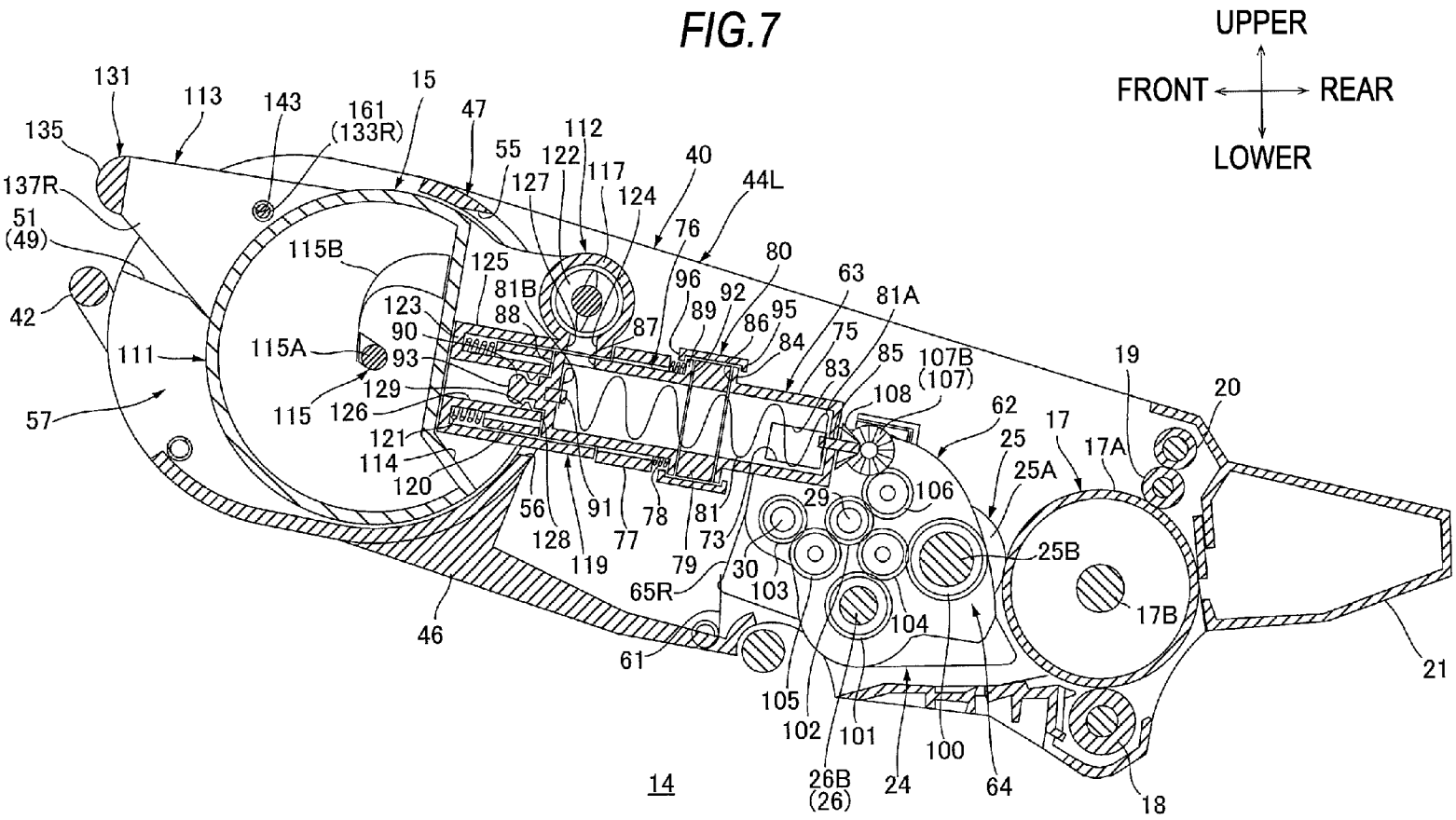
FIG. 7 is a cross-sectional view illustrating a state where the toner cartridge illustrated in FIG. 6 is mounted to the drum cartridge illustrated in FIG. 3A.

As illustrated in FIG. 7, the toner cartridge 15 is positioned in front of the partition wall 47 in a state of being mounted on the toner cartridge mounting portion 57. In other words, the partition wall 47 is positioned between the toner cartridge 15 and the developing unit 24.

At this time, the right end of the agitator shaft 115A is fitted into the rear end of the second groove 52 of the sidewall 44R of the drum unit 14 as illustrated in FIG. 8. The left end of the agitator shaft 115A is fitted into the rear end of the second groove 52 of the sidewall 44L of the drum unit 14.

In addition, the first rod 161 of the interlocking portion 133R is fitted into the fixing hole 50 of the sidewall 44R. Then, the fixing surface 166 of the first rod 161 of the interlocking portion 133R comes in contact with the inner circumferential surface of the fixing hole 50. The first rod 161 of the interlocking portion 133L is fitted into the fixing hole 50 of the sidewall 44L. Then, the fixing surface 166 of the first rod 161 of the interlocking portion 133L comes in contact with the inner circumferential surface of the fixing hole 50.

As illustrated in FIG. 7, the supply portion 112 protrudes rearward from the partition wall 47 through the insertion hole 55 of the partition wall 47. The receiving portion 119 of the supply portion 112 is coupled to the coupling tube 76 of the conveyance portion 63 of the developing unit 24.

The projection portion 90 of the coupling tube 76 of the conveyance portion 63 is fitted into the inner cylinder portion 126 of the receiving portion 119. The protrusion portion 93 of the projection portion 90 is positioned in front of the plate spring 129 of the inner cylinder portion 126. Thus, the plate spring 129 regulates movement of the coupling tube 76 toward the rear with respect to the receiving portion 119.

In addition, the second contact surface 88 of the coupling tube 76 comes in contact with the first contact surface 128 of the inner cylinder portion 126 of the receiving portion 119. Thus, the first contact surface 128 regulates movement of the coupling tube 76 toward the front with respect to the receiving portion 119.

At this time, the first shutter 77 comes in contact with the outer cylinder portion 125 of the receiving portion 119 and is positioned at the open position against the biasing force of the biasing member 78.

The second shutter 120 comes in contact with the second contact surface 88 of the coupling tube 76 and is positioned at the open position against the biasing force of the biasing member 121.

In a state where the receiving portion 119 and the coupling tube 76 are coupled to each other, the toner supply port 124 and the communication opening 127 of the receiving portion 119 face the toner receiving port 87 of the coupling tube 76.

4. Details of Main Body

Figure 11:
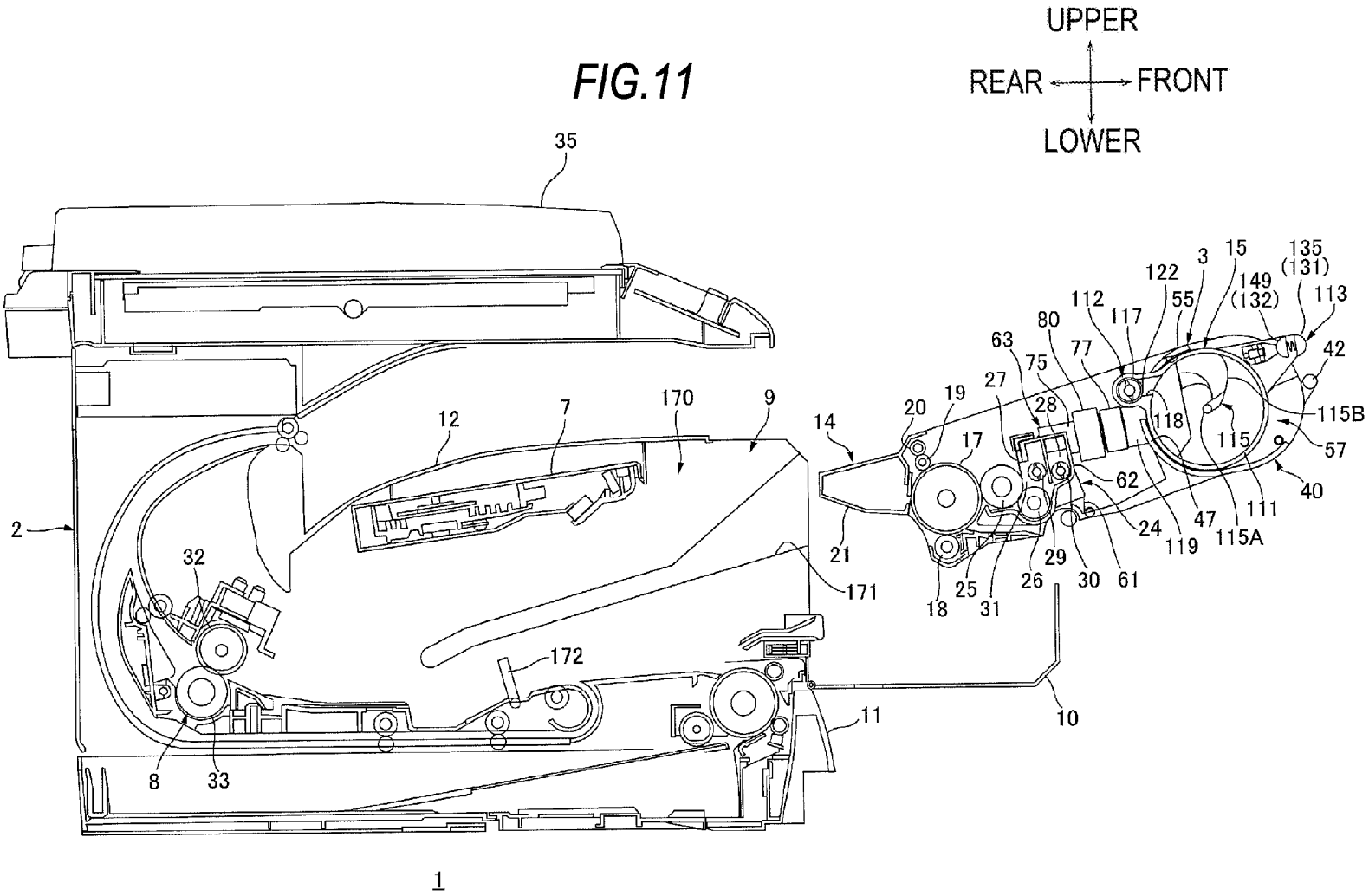
FIG. 11 is an explanatory diagram for explaining an example of a mounting-and-demounting operation of the process cartridge with respect to the image forming apparatus.

As illustrated in FIG. 11, the main body 2 includes a right sidewall 170 having a receiving groove 171, a left sidewall (not illustrated) having the receiving groove 171, and two separation members 172.

The sidewall 170 is positioned at the right end of the main body 2. The sidewall 170 extends in the up-down direction and the front-rear direction. The sidewall 170 has a plate shape.

The receiving groove 171 is recessed outward in the right-left direction from an inner surface in the right-left direction of the sidewall 170. The receiving groove 171 extends rearward and downward from the opening 9.

The sidewall (not shown) is positioned at the left end of the main body 2. The sidewall (not shown) has the receiving groove 171 in the inner surface in the right-left direction thereof, similarly to the sidewall 170.

The receiving groove 171 of the sidewall 170 and the sidewall which is not illustrated, receives the drum shaft 17B of the photosensitive drum 17 of the process cartridge 3.

As a result, the main body 2 supports the process cartridge 3.

The two separation members 172 are positioned in front of the rear lower end of the receiving groove 171 as viewed in the right-left direction. The two separation members 172 are spaced apart from each other in the right-left direction with an interval, as illustrated in FIG. 2. The separation member 172 extends in the up-down direction as illustrated in FIG. 3B. The separation member 172 has an almost rectangular column shape. The separation member 172 is pivotally rotatable around a lower end of the separation member 172. An upper end of the left separation member 172 faces a front end of the collar 26CL of the supply roller 26. As illustrated in FIG. 2, an upper end of the right separation member 172 faces a front end of the collar 26CR.

5. Mounting-and-Demounting Operations of Toner Cartridge and Process Cartridge The toner cartridge 15 is mountable to and demountable from the drum unit 14 even in either a state where the drum unit 14 is mounted to the main body 2 or a state where the drum unit 14 is demounted from the main body 2.

In the following description, mounting-and-demounting operations of the toner cartridge 15 in a state where the drum unit 14 is mounted to the main body 2 will be described.

(1) Demounting Operation of Toner Cartridge

Figure 10:
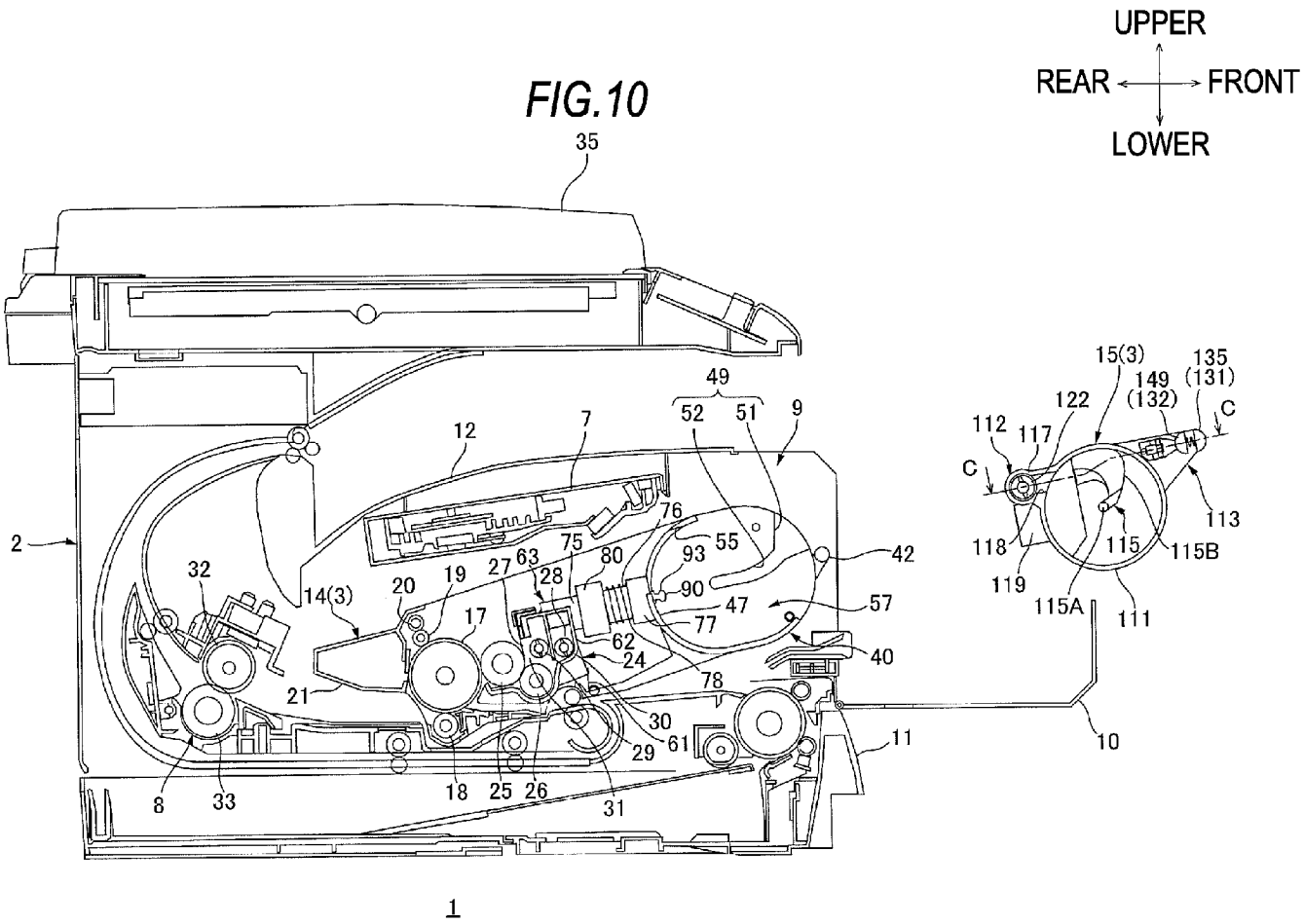
FIG. 10 is an explanatory diagram for explaining an example of a mounting-and-demounting operation of the toner cartridge with respect to the drum cartridge.

When demounting the toner cartridge 15 from the drum unit 14, a worker moves the front cover 10 of the main body 2 to be positioned at the open position as illustrated in FIG. 10.

Subsequently, the worker grips the first grip 135 of the stationary handle 131 of the handle unit 113 integrally with the second grip 149 of the movable handle 132.

At this time, as illustrated in FIGS. 8 and 9, the worker operates such that the second grip 149 of the movable handle 132 approaches the first grip 135 of the stationary handle 131 and the movable handle 132 moves from the first position to the second position, against the biasing force of the biasing member 154.

Then, the boss 167 of the interlocking portion 133R is moved to ride on the inclined portion 157 of the fourth wall 151R and then moves it to the left. In addition, the boss 167 of the interlocking portion 133L is moved to ride on the inclined portion 157 of the fourth wall 151L and then moves it to the right.

Thus, the interlocking portion 133R and the interlocking portion 133L moves from the lock position to the unlock position against the biasing force of the biasing member 164.

Then, the first rod 161 of the interlocking portion 133R falls out from the fixing hole 50 of the sidewall 44R. Further, the first rod 161 of the interlocking portion 133L falls out from the fixing hole 50 of the left sidewall 44L.

In this way, the contact of the fixing surface 166 of the first rod 161 and the inner circumferential surface of the fixing hole 50 is released.

Then, the worker pulls frontward and upward the toner cartridge 15 from the drum unit 14 as illustrated in FIG. 10.

As a result, the toner cartridge 15 is demounted from the drum unit 14.

When the toner cartridge 15 is uncoupled from the developing unit 24, the first shutter 77 is positioned at the closed position by the biasing force of the biasing member 78 as illustrated in FIG. 4, and closes the toner receiving port 87. As illustrated in FIG. 6, the second shutter 120 is positioned at the closed position by the biasing force of the biasing member 121, and closes the toner supply port 124 and the communication opening 127.

(2) Mounting Operation of Toner Cartridge

In order to mount the toner cartridge 15 to the drum unit 14, as illustrated in FIG. 10, the front cover 10 is moved to be positioned at the open position.

Then, the agitator shaft 115A moves along the first groove 51 and the second groove 52 of the guide portion 49 and the toner cartridge 15 is mounted to the toner cartridge mounting portion 57.

At this time, the worker inserts the supply portion 112 into the insertion hole 55.

Then, the receiving portion 119 of the supply portion 112 is coupled with the coupling tube 76 of the conveyance portion 63. Specifically, as illustrated in FIG. 7, the projection portion 90 of the coupling tube 76 is inserted into the inner cylinder portion 126 of the receiving portion 119.

Thus, the protrusion portion 93 of the projection portion 90 rides over the plate spring 129 of the inner cylinder portion 126 and is positioned in front of the plate spring 129.

By coupling of the receiving portion 119 with the coupling tube 76, the front end of the first shutter 77 comes in contact with the rear end of the outer cylinder portion 125 of the receiving portion 119. Thus, the first shutter 77 is positioned at the open position.

By the coupling of the receiving portion 119 with the coupling tube 76, the rear end of the second shutter 120 comes in contact with the second contact surface 88 of the coupling tube 76 of the conveyance portion 63. Thus, the second shutter 120 is positioned at the open position.

Then, the front cover 10 is moved to be positioned at the closed position.

In this way, as illustrated in FIG. 1, the toner cartridge 15 is mounted to the drum unit 14.

6. Mounting-and-Demounting Operations of Process Cartridge (1) Demounting Operation of Process Cartridge Upon demounting the process cartridge 3 from the main body 2, the front cover 10 of the main body 2 is moved to be positioned at the open position as illustrated in FIG. 11.

Then, the worker grips the drum handle 42 and pulls out frontward and upward the process cartridge 3 from the main body 2.

In this way, the process cartridge 3 moves along the receiving groove 171, and the process cartridge 3 is demounted from the main body 2.

(2) Mounting Operation of Process Cartridge

Upon mounting the process cartridge 3 to the main body 2, the worker inserts the process cartridge 3 into the main body 2 after the front cover 10 was moved to be positioned at the open position.

At this time, the drum shaft 17B of the photosensitive drum 17 of the process cartridge 3 moves along the receiving groove 171, and the process cartridge is mounted.

Then, the front cover 10 is moved to be positioned at the closed position.

In this way, the process cartridge 3 is mounted to the main body 2.

7. Image Forming Operation

As illustrated in FIG. 1, when the image forming apparatus 1 starts an image forming operation, the charging roller 19 uniformly charges the surface of the photosensitive drum 17. The scanning unit 7 irradiates with a laser beam L and exposes the surface of the photosensitive drum 17. Thus, an electrostatic latent image based on image data is formed and carried on the surface of the photosensitive drum 17.

In the toner cartridge 15, as illustrated in FIGS. 5 and 7, the agitator 115 agitates the toner contained in the toner accommodating portion 111, and the toner is conveyed to the supply tube 117 of the supply portion 112 through the communication opening 118.

Subsequently, the auger screw 122 rotates due to a driving force input to the conveyance gear 130 and conveys the toner contained in the supply tube 117 to the right end of the supply tube 117.

Then, as illustrated in FIG. 7, the toner is supplied to the coupling tube 76 through the toner supply port 124, the communication opening 127, and the toner receiving port 87.

Next, the coil spring 81 rotates due to a driving force input to the gear train 64 and conveys the toner contained in the coupling tube 76 to the rear end of the conveyance tube 75.

Then, the toner is supplied to the toner accommodating portion 28 of the developing unit 24 through the second communication opening 83 and the first communication opening 73 as illustrated in FIGS. 3A and 7.

Subsequently, as illustrated in FIGS. 1 and 3A, the second screw 30 conveys the toner contained in the toner accommodating portion 28 in the right-left direction. The toner contained in the toner accommodating portion 28 is supplied to the developing portion 31 by passing through the openings provided in the right-left direction at both ends of the compartment wall 70.

The first screw 29 conveys the toner contained in the developing portion 31 in the right-left direction. The toner contained in the developing portion 31 is supplied to the supply roller 26.

Then, the supply roller 26 supplies the toner contained in the developing portion 31 to the developing roller 25. At this time, the toner is positively charged by friction between the developing roller 25 and the supply roller 26 and is carried on the developing roller 25. The layer thickness regulation blade 27 regulates a layer thickness of the toner carried on the developing roller 25 with a certain thickness.

Then, the toner carried on the developing roller 25 is supplied to the electrostatic latent image on the surface of the photosensitive drum 17. Thus, a toner image is carried on the surface of the photosensitive drum 17.

As illustrated in FIG. 1, the sheets P are supplied one by one between the photosensitive drum 17 and the transfer roller 18 from the sheet supply tray 11 at a predetermined timing. The toner image on the surface of the photosensitive drum 17 is transferred to the sheet P while the sheet P is passing between the photosensitive drum 17 and the transfer roller 18.

Subsequently, the sheet P is applied with heat and pressure while passing between the heating roller 32 and the pressing roller 33. Thereby, the toner image on the sheet P is thermally fixed to the sheet P.

The sheet P is then loaded in the sheet discharge tray 12.

In the image forming operation described above, as illustrated in FIGS. 3B and 7, the developing unit 24 moves with respect to the photosensitive drum 17 due to the rotation of the photosensitive drum 17 and the developing roller 25. The developing unit 24 moves in the front-rear direction along the first elongate hole 59 and the second elongate hole 60.

At this time, the receiving portion 119 and the coupling tube 76 are coupled to each other, whereby the coupling tube 76 does not move and the conveyance tube 75 moves in the front-rear direction, in the developing unit 24.

The buffer member 79 of the developing unit 24 is deformed that is compressed in the front-rear direction. Therefore, the conveyance tube 75 of the developing unit 24 moves with respect to the coupling tube 76 of the developing unit 24 in a state where the toner supply port 124 faces the toner receiving port 87.

8. Contact/Separation Operation Between Photosensitive Drum and Developing Roller As illustrated in FIGS. 3A and 3B, the separation member 172 pivotally rotates clockwise around the lower end as seen in left side view, during a cleaning operation or a warm-up operation, for example.

Consequently, the separation member 172 presses frontward the collar 26CR and the collar 26CL of the supply roller 26. Then, the developing unit 24 moves frontward along the first elongate hole 59 and the second elongate hole 60, against the biasing force of the spring 61. The developing unit 24 moves between a contact position, at which the developing roller 25 comes in contact with the photosensitive drum 17, and a separation position, at which the developing roller 25 is separated from the photosensitive drum 17.

When the developing roller 25 is separated from the photosensitive drum 17, the receiving portion 119 and the coupling tube 76 are coupled to each other, whereby the coupling tube 76 does not move and the conveyance tube 75 moves frontward, in the developing unit 24.

At this time, the buffer member 79 of the developing unit 24 is deformed that is compressed in the front-rear direction as illustrated in FIG. 7. Therefore, the conveyance tube 75 of the developing unit 24 moves with respect to the coupling tube 76 of the developing unit 24 in a state where the toner supply port 124 faces the toner receiving port 87.

9. Operational Advantages (1) According to the image forming apparatus 1 and the drum unit 14, as illustrated in FIG. 7, the conveyance tube 75 of the developing unit 24 is movable with respect to the coupling tube 76 of the developing unit 24 in a state where the toner supply port 124 faces the toner receiving port 87.

With this structure, as the developing frame 62 moves with respect to the photosensitive drum 17, the conveyance tube 75 moves with respect to the coupling tube 76.

Therefore, when the developing frame 62 moves with respect to the photosensitive drum 17, the toner supply port 124 and the toner receiving port 87 do not deviate. As a result, it is possible to suppress toner leakage between the toner cartridge 15 and the developing unit 24.

In addition, when the developing frame 62 moves with respect to the photosensitive drum 17, the conveyance tube 75 moves with respect to the toner cartridge 15. As a result, even when the large amount of toner is contained in the toner cartridge 15, it is possible to stably swing the developing unit 24.

(2) According to the image forming apparatus 1, as illustrated in FIG. 7, the spring 61 presses the developing frame 62 rearward, and thus the conveyance tube 75 can be moved according to the pressing of the spring 61, in the developing unit 24.

(3) According to the image forming apparatus 1, as illustrated in FIGS. 3A and 3B, it is possible to guide the developing unit 24 by using the first elongate hole 59 and the second elongate hole 60 extending in the front-rear direction.

Then, since the spring 61 presses the developing frame 62 rearward, it is possible to reliably move the conveyance tube 75 in the front-rear direction by using the first elongate hole 59 and the second elongate hole 60.

As a result, it is possible to stably make the developing roller 25 come in contact with the photosensitive drum 17.

(4) The image forming apparatus 1 includes the separation member 172 that is configured to move the developing unit 24 from the contact position to the separation position in the front-rear direction as illustrated in FIGS. 2 and 3B.

Then, even when the developing roller 25 is separated from the photosensitive drum 17 by the separation member 172, it is possible to maintain a state where the toner supply port 124 and the communication opening 127 face the toner receiving port 87 and to suppress the toner leakage between the toner cartridge 15 and the developing unit 24.

(5) According to the image forming apparatus 1, as illustrated in FIG. 7, due to the deformation of the buffer member 79, it is possible to permit the movement of the conveyance tube 75 with respect to the coupling tube 76.

(6) According to the image forming apparatus 1, as illustrated in FIG. 7, due to the buffer member 79, it is possible to permit the movement of the conveyance tube 75 with respect to the coupling tube 76 in the front-rear direction.

(7) According to the image forming apparatus 1, as illustrated in FIG. 7, it is possible to reliably suppress the toner leakage between the conveyance tube 75 and the coupling tube 76 by using buffer member 79.

(8) According to the image forming apparatus 1, as illustrated in FIG. 7, since the buffer member 79 is the urethane foam, it is possible to permit the movement of the conveyance tube 75 with respect to the coupling tube 76 and to suppress the toner leakage between the conveyance tube 75 and the coupling tube 76 at the same time.

(9) According to the image forming apparatus 1, as illustrated in FIG. 7, the buffer member 79 comes in contact with the first bonding surface 86 of the first flange portion 84 of the conveyance tube 75, and thus the buffer member 79 can be deformed in a state of coming in contact with the first flange portion 84 of the conveyance tube 75 without any gap.

As a result, it is possible to suppress the toner leakage between the conveyance tube 75 and the buffer member 79.

(10) According to the image forming apparatus 1, as illustrated in FIG. 7, the first bonding surface 86 extends in the direction orthogonal substantially to the moving direction of the conveyance tube 75.

Due to the movement of the conveyance tube 75, therefore, it is possible to suppress the release of the buffer member 79 from the conveyance tube 75.

Accordingly, it is possible to reliably suppress the toner leakage between the conveyance tube 75 and the buffer member 79.

(11) According to the image forming apparatus 1, as illustrated in FIG. 7, the buffer member 79 is bonded to the second bonding surface 92 of the second flange portion 89, and thus the buffer member 79 can be deformed in a state of coming in contact with the second flange portion 89 of the coupling tube 76 without any gap.

Therefore, it is possible to suppress the toner leakage between the coupling tube 76 and the buffer member 79.

(12) According to the image forming apparatus 1, as illustrated in FIG. 7, the second bonding surface 92 extends in the direction orthogonal substantially to the moving direction of the conveyance tube 75.

Therefore, it is possible to suppress the release of the buffer member 79 from the coupling tube 76, due to the movement of the conveyance tube 75.

Accordingly, it is possible to reliably suppress the toner leakage between the coupling tube 76 and the buffer member 79.

(13) According to the image forming apparatus 1, as illustrated in FIG. 7, since the coupling tube 76 has substantially the cylindrical shape extending in the front-rear direction, it is possible to convey the toner in the front-rear direction with a simple configuration.

(14) According to the image forming apparatus 1, as illustrated in FIG. 7, the coil spring 81 is positioned over the inside of the coupling tube 76 and the inside of the conveyance tube 75, and thus it is possible to reliably convey the toner to the conveyance tube 75.

(15) According to the image forming apparatus 1, as illustrated in FIG. 7, when the conveyance tube 75 moves with respect to the coupling tube 76, the coil spring 81 can be elastically deformed.

Therefore, the conveyance tube 75 can be smoothly moved, and the toner contained in the coupling tube 76 can be conveyed by the coil spring 81 at the same time.

(16) According to the image forming apparatus 1, as illustrated in FIG. 7, the rear end 81A of the coil spring 81 is supported by the rear end of the conveyance tube 75, the front end 81B of the coil spring 81 is supported by the front end of the coupling tube 76, and thus the toner can be reliably conveyed from the coupling tube 76 to the conveyance tube 75 by the coil spring 81.

(17) According to the image forming apparatus 1, as illustrated in FIG. 7, the second contact surface 88 of the coupling tube 76 comes in contact with the first contact surface 128 of the receiving portion 119, and thus the coupling tube 76 can be reliably coupled to the toner cartridge 15.

(18) According to the image forming apparatus 1, as illustrated in FIG. 7, the first contact surface 128 of the receiving portion 119 extends in the direction orthogonal substantially to the moving direction of the conveyance tube 75.

Therefore, the coupling tube 76 can stably come in contact with the first contact surface 128 of the receiving portion 119.

(19) According to the image forming apparatus 1, as illustrated in FIG. 7, the second contact surface 88 of the coupling tube 76 extends in the direction orthogonal substantially to the moving direction of the conveyance tube 75.

Therefore, the receiving portion 119 can stably come in contact with the second contact surface 88 of the coupling tube 76.

(20) According to the image forming apparatus 1, as illustrated in FIG. 7, the projection portion 90 is engaged with the inner cylinder portion 126 to face the protrusion portion 93 and the plate spring 129 each other, and thus it is possible to regulate the movement of the coupling tube 76 to the receiving portion 119.

As a result, it is possible to reliably maintain a state where the toner supply port 124 and the communication opening 127 face the toner receiving port 87.

(21) According to the image forming apparatus 1, as illustrated in FIG. 7, it is possible to mount the toner cartridge 15 to the predetermined toner cartridge mounting portion 57.

(22) According to the image forming apparatus 1, as illustrated in FIG. 8, the first rod 161 of the handle unit 113 of the toner cartridge 15 is fitted into the fixing hole 50 of the toner cartridge mounting portion 57, and thus the toner cartridge 15 can be fixed to the toner cartridge mounting portion 57.

(23) According to the image forming apparatus 1, as illustrated in FIG. 8, since the fixing surface 166 of the first rod 161 extends in the direction orthogonal to the conveyance tube 75, the fixing surface 166 comes in contact with the inner circumferential surface of the fixing hole 50, and thus the toner cartridge 15 can be suppressed from moving frontward.

Therefore, even when being pushed from the developing unit 24, the toner cartridge 15 can be suppressed from being removed from the toner cartridge mounting portion 57.

(24) According to the image forming apparatus 1, as illustrated in FIG. 7, it is possible to reliably couple the coupling tube 76 to the toner cartridge 15 through the notch 56 of the partition wall 47 while mounting the toner cartridge 15 to the toner cartridge mounting portion 57.

(25) According to the image forming apparatus 1, as illustrated in FIG. 3A, since the second groove 52 of the guide portion 49 of the toner cartridge mounting portion 57 has the straight part extending in the front-rear direction, the toner cartridge 15 can be mounted to the toner cartridge mounting portion 57 in the front-rear direction.

Therefore, when mounting the toner cartridge 15, it is possible to smoothly couple the receiving portion 119 of the supply portion 112 of the toner cartridge 15 to the coupling tube 76 of the developing unit 24 in the front-rear direction.

(26) According to the image forming apparatus 1, as illustrated in FIG. 7, the arrangement direction of the photosensitive drum 17 and the developing roller 25 is substantially equal to the moving direction of the conveyance tube 75.

Therefore, it is possible to move the conveyance tube 75 to the coupling tube 76 in the arrangement direction of the photosensitive drum 17 and the developing roller 25.

As a result, when the developing roller 25 moves with respect to the photosensitive drum 17 in the arrangement direction of the photosensitive drum 17 and the developing roller 25, it is possible to move the conveyance tube 75 to the coupling tube 76 while maintaining a state where the toner supply port 124 and the toner receiving port 87 face each other.

10. Modification Example

The invention is not limited to the embodiment described above. In the embodiment described above, for example, the receiving portion 119 of the toner cartridge 15 includes the outer cylinder portion 125 provided with the communication opening 127 and the inner cylinder portion 126. However, the receiving portion 119 may be configured with only the inner cylinder portion 126 without including the outer cylinder portion 125 provided with the communication opening 127. In such a case, the coupling tube 76 of the developing unit 24 is coupled to the inner cylinder portion 126 of the receiving portion 119, and thus the toner supply port 124 and the toner receiving port 87 face each other.

In the embodiment described above, the partition wall 47 includes the insertion hole 55 and the notch 56. However, the partition wall 47 may include only the insertion hole 55 without including the notch 56.

In the embodiment described above, furthermore, the drum unit 14 is configured to be mountable to and demountable from the main body 2. However, the drum unit 14 may be configured not to be mountable to and demountable from the main body 2.

In the embodiment described above, the developing unit 24 is configured not to be mountable to and demountable from the drum unit 14. However, the developing unit 24 may be configured to be mountable to and demountable from the drum unit 14.

In addition, the number of springs 61 is two, but may be one or at least three without being limited thereto.

Furthermore, the number of separation members 172 is two, but may be one without being limited thereto.

What is claimed is:

1. An image forming apparatus comprising:
- a photosensitive drum;
- a toner cartridge having a toner supply port; and
- a developing unit including:
  - a developing roller;
  - a developing frame; and
  - a conveyance portion capable of conveying toner contained in the toner cartridge to the developing frame, the conveyance portion including:
    - a coupling tube capable of being coupled to the toner cartridge and having a toner receiving port that faces the toner supply port in a state where the coupling tube is coupled to the toner cartridge;
    - a conveyance tube fixed to the developing frame, the conveyance tube being movable with respect to the coupling tube, in a state where the coupling tube is coupled to the toner cartridge and the toner receiving port faces the toner supply port; and
    - a shutter movable between an open position, at which the toner receiving port is opened in a state where the coupling tube is coupled to the toner cartridge, and a closed position, at which the toner receiving port is closed in a state where the coupling tube is uncoupled from the toner cartridge.

2. The image forming apparatus according to claim 1, wherein the conveyance portion includes a buffer member that is positioned between the conveyance tube and the coupling tube and is deformable in a moving direction of the conveyance tube.

3. The image forming apparatus according to claim 2, wherein the buffer member is used to seal a region between the conveyance tube and the coupling tube.

4. The image forming apparatus according to claim 3, wherein the buffer member is urethane foam.

5. The image forming apparatus according to claim 4, wherein the conveyance tube has a bonding surface to which the buffer member is bonded, and the bonding surface extends in a direction orthogonal to the moving direction of the conveyance tube.

6. The image forming apparatus according to claim 1, wherein the coupling tube has a cylindrical shape extending in a moving direction of the conveyance tube.

7. The image forming apparatus according to claim 1,
- wherein the conveyance portion includes a conveyance member configured to convey toner in the coupling tube to the developing frame, and
- wherein at least a part of the conveyance member is positioned inside the coupling tube.

8. The image forming apparatus according to claim 7, wherein the conveyance member is a coil spring.

9. The image forming apparatus according to claim 8, wherein the conveyance member includes:
- a first end that is supported by the conveyance tube; and
- a second end that is positioned at a side opposite to the first end and is supported by the coupling tube.

10. The image forming apparatus according to claim 1,
- wherein the toner cartridge includes a receiving portion that receives the coupling tube, wherein the receiving portion has a first contact surface that extends in a direction orthogonal to a moving direction of the conveyance tube, and wherein the coupling tube has a second contact surface that extends in the direction orthogonal to the moving direction of the conveyance tube and comes in contact with the first contact surface.

11. The image forming apparatus according to claim 10, wherein the coupling tube includes a projection portion that extends from the second contact surface in the moving direction of the conveyance tube, and wherein the receiving portion includes a recess portion that receives the projection portion.

12. The image forming apparatus according to claim 1, further comprising:

a frame that supports the photosensitive drum and the developing unit, the toner cartridge being mounted to the frame, wherein the frame includes a spring that is used to press the developing roller toward the photosensitive drum and press the developing frame in a moving direction of the conveyance tube.

13. The image forming apparatus according to claim 12, wherein the frame includes a first guide that guides the developing frame and extends in a pressing direction in which the spring presses the developing frame.

14. The image forming apparatus according to claim 13, wherein the frame includes a second guide that guides mounting-and-demounting of the toner cartridge and extends in the moving direction of the conveyance tube.

15. The image forming apparatus according to claim 1, further comprising:

a frame that supports the photosensitive drum and the developing unit, the toner cartridge being mounted to the frame, wherein the frame includes a partition wall between the developing unit and the toner cartridge, and wherein the partition wall includes an insertion hole into which the coupling tube is inserted.

16. The image forming apparatus according to claim 1, wherein the conveyance tube moves in an arrangement direction of the photosensitive drum and the developing roller.

17. The image forming apparatus according to claim 1, further comprising:

a separation member that is used to separate the developing roller from the photosensitive drum, wherein the separation member moves the developing frame in a moving direction of the conveyance tube at a time of separation of the developing roller.

18. A developing unit to which a toner cartridge having a toner supply port is mountable, comprising:

a developing roller;

a developing frame; and a conveyance portion configured to convey toner contained in the toner cartridge to the developing frame, the conveyance portion including:

a coupling tube capable of being coupled to the toner cartridge, the coupling tube having a toner receiving port that faces the toner supply port when the coupling tube is coupled to the toner cartridge;

a conveyance tube fixed to the developing frame, the conveyance tube being movable with respect to the coupling tube when the coupling tube is coupled to the toner cartridge and the toner receiving port faces the toner supply port; and a shutter movable between an open position, at which the toner receiving port is opened in a state where the coupling tube is coupled to the toner cartridge, and a closed position, at which the toner receiving port is closed in a state where the coupling tube is uncoupled from the toner cartridge.

* * * * *